US010086297B2

(12) United States Patent
Van Asch et al.

(10) Patent No.: US 10,086,297 B2
(45) Date of Patent: Oct. 2, 2018

(54) OBJECT MOVEMENT CONTROL APPARATUS AND METHOD

(71) Applicant: Bungy New Zealand Limited, Invercargill (NZ)

(72) Inventors: Henry Van Asch, Queenstown (NZ); David Mitchell, Queenstown (NZ); Tim Porter, Christchurch (NZ); Geoff Wilson, Queenstown (NZ); Kevin Andrew Wright, Christchurch (NZ)

(73) Assignee: Bungy New Zealand Limited, Invercargill (NZ)

( * ) Notice: Subject to any disclaimer, the term of this patent is extended or adjusted under 35 U.S.C. 154(b) by 0 days.

(21) Appl. No.: 15/552,169

(22) PCT Filed: Feb. 19, 2016

(86) PCT No.: PCT/NZ2016/050023

§ 371 (c)(1),
(2) Date: Aug. 18, 2017

(87) PCT Pub. No.: WO2016/133408

PCT Pub. Date: Aug. 25, 2016

(65) Prior Publication Data

US 2018/0036644 A1 Feb. 8, 2018

(30) Foreign Application Priority Data

Feb. 20, 2015 (NZ) ..... 705198

(51) Int. Cl.

| | |
|---|---|
| ***A63G 31/00*** | (2006.01) |
| ***A63G 21/20*** | (2006.01) |
| ***A63G 21/22*** | (2006.01) |

(52) U.S. Cl.
CPC ..... *A63G 21/22* (2013.01); *A63G 21/20* (2013.01); *A63G 31/00* (2013.01); *A63G 2031/002* (2013.01)

(58) Field of Classification Search
CPC .... A63B 5/00; A63B 5/16; A63B 7/00; A63G 31/00; A63G 31/08; A63G 31/16; A63G 21/00; A63G 21/20; A63G 21/22
(Continued)

(56) References Cited

U.S. PATENT DOCUMENTS

| | | |
|---|---|---|
| 2,478,004 A | 8/1949 | Newell |
| 4,431,182 A | 2/1984 | Reynolds |

(Continued)

FOREIGN PATENT DOCUMENTS

WO 2005009569 A1 2/2005

OTHER PUBLICATIONS

BunjPack Junp Guide 2014, 16 pages.
(Continued)

*Primary Examiner* — Kien Nguyen
(74) *Attorney, Agent, or Firm* — Perkins Coie LLP

(57) ABSTRACT

Described herein is an apparatus and method to convey an object through the air in a controlled and repeatable manner. The apparatus may comprise an object attached to at least one resilient member, the resilient member or members constraining object movement in a substantially vertical y-axis direction. The apparatus may also comprise at least one support member coupled to the at least one resilient member, and the support member or members constrain object movement in a substantially horizontal x-axis direction. In use, the resilient member is energized, movement initiated, and object movement then occurs in both an x-axis and y-axis direction, the movement path substantially governed by the resilient member(s) and the support member(s).
(Continued)

The apparatus and method may allow the object to experience a variety of movement sensations, one being the feeling of flight or gliding.

19 Claims, 25 Drawing Sheets

(58) Field of Classification Search
USPC ..... 472/119, 131, 134, 135; 482/142, 143
See application file for complete search history.

(56) References Cited

U.S. PATENT DOCUMENTS

| | | | | |
|---|---|---|---|---|
| 4,737,107 | A | 4/1988 | Bories et al. | |
| 5,421,783 | A * | 6/1995 | Kockelman | A63B 5/16 472/131 |
| 5,427,576 | A * | 6/1995 | Pfeiffer | A63B 5/16 472/131 |
| 5,649,866 | A | 7/1997 | Balwanz | |
| 5,660,113 | A | 8/1997 | Lehotsky | |
| 6,360,669 | B1 | 3/2002 | Albrich | |
| 6,443,847 | B1 | 9/2002 | van Asch et al. | |
| 6,561,916 | B2 | 5/2003 | Mehrman et al. | |
| 6,808,459 | B2 | 10/2004 | Checketts | |
| 6,875,115 | B2 | 4/2005 | Fea | |
| 7,066,822 | B2 | 6/2006 | Cochron | |
| 7,381,137 | B2 | 6/2008 | Steele et al. | |
| 7,465,235 | B2 | 12/2008 | Evans | |
| 7,485,046 | B2 * | 2/2009 | Dekker | A63B 7/00 472/135 |
| 7,666,103 | B2 | 2/2010 | Pondorfer et al. | |
| 8,061,483 | B2 | 11/2011 | Moriarty | |
| RE43,028 | E | 12/2011 | Kitchen et al. | |
| 8,667,956 | B2 | 3/2014 | Kamen et al. | |
| 8,784,227 | B2 * | 7/2014 | Speedie | A47D 9/02 472/119 |
| 9,005,044 | B2 * | 4/2015 | Checketts | A63G 31/08 472/134 |
| 9,120,023 | B1 | 9/2015 | Burrouhs | |
| 2005/0026757 | A1 | 2/2005 | Creary | |
| 2009/0312111 | A1 | 12/2009 | Gil et al. | |
| 2011/0147124 | A1 | 6/2011 | Moriarty et al. | |
| 2014/0360398 | A1 | 12/2014 | Chick | |

OTHER PUBLICATIONS

AJ Hackett Bungy "Nevis Swing—The Worlds Biggest Swing",[retrieved from internet on Apr. 22, 2016]< http:/ /web.archive.org/web/20110817024814/http://www.bungy.eo.nz/thenevis / thenevisswing> published on Aug. 17, 2011 as per Wayback Machine, 3 pages.

http://www.bun-j-ride.com/, retrieved from internet on Aug. 18, 2017, 3 pages.

PCT Application No. PCT/NZ2016/050023, International Preliminary Report on Patentability, dated Jun. 20, 2017, 9 pages.

PCT Application No. PCT/NZ2016/050023, International Search Report and Written Opinion, dated May 3, 2016 , 11 pages.

* cited by examiner

| | Line Details | | System Mass | | Launch ideal | Launch Conditions | | Bungy |
|---|---|---|---|---|---|---|---|---|
| Test ID | Cord detail | Length [m] | Rider [kg] | Trolley [kg] | Stretch [m] | Stretch [m] | Bungy load [N] | Spring [N/m] |
| Test 1 | Cord 1 | 20 m | 85kg | 20kg | 55m | 55 | 2325 | 42.3 |
| Test 2 | Cord 1 | 20 m | 38kg | 20kg | 40m | 40 | 1410 | 35.3 |
| Test 3 | Cord 3 | 20 m | 38kg | 20kg | 40m | 40 | 3380 | 84.5 |
| Test 4 | Cord 3 | 20 m | 85kg | 20kg | 52m | 52 | 4420 | 85.0 |
| Test 5 | Cord 3 | 20 m | 135kg | 20kg | 70m | 70 | 5320 | 76.0 |

FIGURE 51

OBJECT MOVEMENT CONTROL APPARATUS AND METHOD

CROSS-REFERENCE TO RELATED APPLICATION(S)

This application is a 35 U.S.C. § 371 National Stage application of International Application No. PCT/NZ2016/050023, entitled "OBJECT MOVEMENT CONTROL APPARATUS AND METHOD," filed on Feb. 19, 2016, which claims priority to New Zealand Application No. NZ705198, filed Feb. 20, 2015, the contents of which are incorporated by reference herein in their entireties.

TECHNICAL FIELD

Described herein is an object movement control apparatus and method. More specifically, apparatus and methods are described to convey an object through the air in a controlled and repeatable manner.

BACKGROUND

Various apparatus exist for moving objects through space. In a recreational setting, a bungee (also known as 'bungy') jump is a now well known apparatus to allow a user to experience free fall in a safe, controlled and repeatable manner. Bungee jumps however are limited to movement primarily in a vertical y-axis direction.

Base jumping, flight or gliding offer quite different sensations with the rider experiencing acceleration in the horizontal or x-axis direction, side to side movement, and vertical y-axis movement. A further point of difference with these activities to a bungee jump is the sensation of lift upwards during movement and not only at the maximum movement point of a jump as is the case for a bungee jump.

Meeting safety requirements is however a critical imperative in such applications, particularly where the object is a human. The primary reference that details the acceptable forces and accelerations suitable for participant exposure is ASTM F2291-14 Standard Practice for Design of Amusement Rides and Devices. The purpose of this practice is to provide designers, engineers, manufacturers, owners, and operators with criteria and references for use in designing amusement rides and devices or a major modification for amusement rides or devices. Within this standard, a coordinate system is defined for the direction of an applied acceleration on a participant, as shown in FIG. 1.

Acceleration limits are also provided in ASTM F2291-14 for each orthogonal axis, as well as limits for the allowable combined magnitudes of orthogonal accelerations. ASTM F2291-14 provides a detailed method to determine the compliance of an activity against the standard. A simplified graph of the axial acceleration limits is provided for reference in FIG. 2.

It may be desirable to combine the vertical movement an object or person experiences in a bungee jump with the flight or glide path characteristics an object or person experiences from base jumping, flight or gliding and doing this in a safe, controlled and repeatable manner (meeting or exceeding the above noted standards) or, at least to provide the public with a choice.

Further aspects and advantages of the apparatus and method will become apparent from the ensuing description that is given by way of example only.

SUMMARY

Described herein is an apparatus and method to convey an object through the air in a controlled and repeatable manner.

The object may be a person but could also be an object or animal. The apparatus and method allow the object to experience a variety of movement sensations, one being the feeling of flight or gliding.

In a first aspect, there is provided an apparatus to control movement of an object, the apparatus comprising:

(a) at least one object attached to at least one resilient member, wherein the at least one resilient member constrains movement of the at least one object in a substantially vertical y-axis direction; and (b) at least one support member moveably coupled to the at least one resilient member, wherein the at least one support member constrains resilient member movement along a set path relative to the support member and in doing so imparts movement of the object in a set path direction;

wherein, in use, the at least one resilient member is energized and movement of the at least one object initiated, substantially in both the vertical y-axis direction via the at least one resilient member, and the set path direction via the at least one support member.

In a second aspect, there is provided a method of moving an object through space in a controlled manner by the steps of:

(a) selecting an apparatus substantially as described above;

(b) attaching at least one object to the at least one resilient member;

(c) energising the at least one resilient member;

(d) initiating movement of the at least one object; and (e) allowing movement of the at least one object in both a vertical y-axis direction via the at least one resilient member, and a set path direction via the at least one support member.

Advantages of the above apparatus and method include the ability to control object movement in at least two directions. Art controlled movement apparatus typically only allow for movement in one primary direction—for example, a bungee line that controls movement in a vertical y-axis. The apparatus described herein introduces a wider variety of movement sensations on the object such as high acceleration and deceleration; suspension at height; gliding; swinging and bouncing. This is however provided for in a comparatively safe and tuneable prescribed path of motion.

BRIEF DESCRIPTION OF THE DRAWINGS

Further aspects of the apparatus and method will become apparent from the following description that is given by way of example only and with reference to the accompanying drawings in which:

FIG. 15 illustrates the energiser trolley and rider trolley being positioned at the launch platform and prepared for the participant to connect with;

FIG. 51 is a table showing measured bungee cord spring rates.

DETAILED DESCRIPTION

Figure 1:
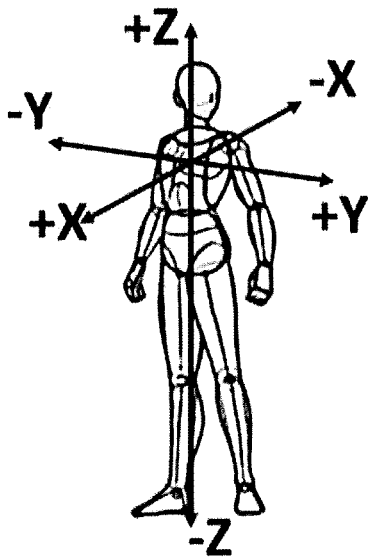
FIG. 1 illustrates ASTM patron containment area acceleration coordinate axes.

As noted above, described herein is an apparatus and method to convey an object through the air in a controlled and repeatable manner. The object may be a person but could also be an object or animal. The apparatus and method allow the object to experience a variety of movement sensations, one being the feeling of flight or gliding.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'couple' or grammatical variations thereof refer to two items being linked together either directly or indirectly.

The term 'resilient' and grammatical variations thereof in the context of a line refers to the line being capable of extending beyond an un-tensioned first length to a tensioned second length, the tensioned second length being at least 1.1 times longer than the un-tensioned first length and, through material memory, returns to a substantially similar un-tensioned first length. The term 'resilient' as used herein may have a similar meaning as the term 'elastic'.

The term 'member' and grammatical variations thereof refers to a line, track, cord, cable, wire, band, or the like, of material which can direct movement of the at least one object in the substantially y-axis direction and/or in the set path direction.

The term 'non-resilient' and grammatical variations thereof in the context of a line refers to a line that may extend from a first un-tensioned length to a second tensioned length but the degree of extension is less than about 1.1 times the first length.

In a first aspect, there is provided an apparatus to control movement of an object, the apparatus comprising:

(a) at least one object attached to at least one resilient member, wherein the at least one resilient member constrains movement of the at least one object in a substantially vertical y-axis direction; and (b) at least one support member moveably coupled to the at least one resilient member, wherein the at least one support member constrains resilient member movement along a set path relative to the support member and in doing so imparts movement of the object in a set path direction;

wherein, in use, the at least one resilient member is energized and movement of the at least one object initiated, substantially in both the vertical y-axis direction via the at least one resilient member, and the set path direction via the at least one support member.

The inventors have developed an apparatus that allows a controlled object movement path in at least two directions. Art controlled movement apparatus typically only allow for movement in one direction—for example, a bungee line that controls movement in a vertical y-axis. The apparatus described herein introduces a wider variety of movement sensations on the object such as high acceleration and deceleration; suspension at height; gliding; swinging and bouncing. The sensation of gliding akin to what a base jumper might experience, but in a controlled and therefore safe manner, is one particular aspect of the apparatus not possible with art apparatus such as a bungee jump.

The set path direction defined by the support member may be: in a substantially horizontal x-axis direction; an S-shaped direction; a curved path; a spiral path; and combinations thereof. As should be appreciated, the set path may be achieved through various support member means, examples including: a cable, steel beams, ropes, rails and other items.

The at least one resilient member may be coupled to the at least one object at one first distal end.

During movement of the object, the at least one support member may be located above at least part of the at least one resilient member.

At least part of the at least one support member may be aligned in an inclined or declined plane relative to a horizontal plane. An incline or decline may be useful to urge movement of the resilient member relative to the support member however, a horizontal support may also be used and some other urging force used to drive relative movement such as a support member moving mechanism.

At least one coupling member may couple the at least one resilient member to the at least one support member. The at least one coupling member may move along the support member. The coupling member may either be: fixed to the support member; free to traverse the support member; or limited in mobility relative to the support member. In one embodiment, the at least one coupling member may couple the at least one resilient member about at least one second distal end of the at least one resilient member to the support member or a part thereof. The at least one coupling member may be at least one zipline trolley although other moveable coupling members may be used.

The at least one support member may be manufactured from a substantially non-resilient material. Examples may include steel cables, rope, steel beams and the like. Resilient materials may also be used depending on the object movement profile desired and reference to a non-resilient material should not be seen as limiting.

The object or objects may be a person, item, or animal and reference herein to one should not be seen as excluding the other. The object or objects may provide a point weight at a first distal end of the resilient member. Embodiments where a person is the object are envisaged as being recreational apparatus akin to the existing bungee jump attractions that currently exist but with an added sensation to the person caused by horizontal x-axis movement as well as vertical y-axis dropping movement.

The at least one resilient member may be energised by:

(a) increasing the gravitational potential energy acting on the at least one resilient member and the at least one object attached to the at least one resilient member; and/or (b) increasing the stored energy in an energising force mechanism that imparts energy, when triggered, to the at least one resilient member and the at least one object attached to the at least one resilient member.

Object movement may be initiated by:

(a) gravity force acting on the object; and/or (b) a stored energy mechanism imparting energy to the object.

By way of example, gravity force initiation may be caused by actions including: falling, stepping, jumping, sliding, rolling, trapdoor, waterslide. As a further example, stored energy mechanism initiation may be achieved through use of items comprising: rubber (tensioned or compressed), springs (tensioned or compressed), falling weights, fluid pressure (air or other), magnetism, motors, or hydraulics.

Initiation may be controlled by: the object, an external trigger or triggers, and combinations thereof. By way of further illustration, initiation control may be caused by actions such as: object (user) motions (falling, stepping, jumping, etc.), pushing a button, cutting a cable, pulling/pushing a release pin, shooting a target, or operating a remote control.

The object may also move in a lateral z-axis direction, the z-axis movement driven by a z-axis force generating means. Examples envisaged of ways to impose a lateral z-axis movement may be via external stimuli such as wind or air movement; and/or via the object directing z-axis movement such as the object being a person that launches themselves in a z-axis direction or a stored energy mechanism that drives movement in a z-axis direction.

The at least one resilient member may be a rubberised material. The degree of resilient member extension may be a function of various factors including line design, line materials used, object weight, object velocity and object direction of travel. The resilient member may include an elastic and/or bias action. The elastic action may be achieved using a rubberised material. The bias action may be achieved by use of a spring.

The at least one support member may have a positive or negative incline through at least part of the length of the member/line. The angle of incline or decline may range from approximately 0.1, or 0.5, or 1, or 5, or 10, or 15, or 20, or 25, or 30, or 35, or 40, or 45, or 50, or 55, or 60, or 65, or 70, or 75, or 80, or 85, or 90 degrees relative to a horizontal plane. In one embodiment, the slope of incline or decline through at least part of the length of the member/line may vary from 0.1 to 70 degrees. Alternatively, the slope of incline or decline through at least part of the length of the line may vary from 5 to 45 degrees. A 5 to 45 degree slope may be useful in a recreational setting where the apparatus is mounted across a valley. Alternatively, the slope of incline or decline through at least part of the length of the line may vary from 45 to 90 degrees. Larger angles may present an alternative object movement profile, for example a fast vertical or near vertical movement along the set path followed by a launch in a substantially vertical y-axis direction on the resilient member/line—in a recreation example, equating to a way of achieving a rapid speed before launch into a bungee jump.

The at least one support member may have a shape selected from: catenary, U-shaped, curved, spiral, J-shaped; and combinations thereof. One distal end of the support member may be higher in a vertical plane than the second distal end of the support member. This arrangement may be useful to impart or retard movement on the resilient member relative to the support member through gravitational energy. Imparting movement might occur when the resilient member and coupling member (if used) is located at an elevated end of the support member. Retarding movement might occur about one end of the support member to slow or stop travel of the resilient member and/or coupling member (if present).

Movement of the at least one resilient member relative to the at least one support member may be governed by at least one stop or re-direction point. Examples of means to achieve a stop or re-direction may include:

(a) Rigid stops—stops that provide a rigid impact point and allow for rapid capture/redirection of the coupling member.

(b) Soft stops—stops that provide an impact point that absorbs energy and allow for a gradual capture/redirection of the coupling member. The stops may or may not impart energy back into the coupling member. This could include springs, rubber, bumpers, dampers, magnets, hydraulics etc.

(c) Directional stops—stops that halt or alter the direction of the coupling member through discrete alteration of the direction of the travel line via inclination or curvature.

(d) Environmental stops—the shape of the non-resilient line and the interaction of environmental conditions, not limited to, but including gravity, wind/air resistance, and/or magnetic attraction.

Movement characteristics of the object may be tuned by:

(a) altering the at least one support member characteristics; and/or (b) altering the at least one resilient member characteristics.

Ways to alter object movement through varying the support member characteristics may be as follows:

(a) the number of support members on which the at least one coupling member/resilient member travels;

(b) the gradient of the support member or members—declined, inclined, horizontal, vertical and/or radial;

(c) the composition of the support member—cable, rope, track and/or rail;

(d) Geometry—the support member can be created in a two-dimensional or three-dimensional form. Options include: straight line, singular curve (catenary, parabolic etc.), or multiple curve (spiralled, looped, S-shaped etc.). The profile of the support member can also be varied through static (allowing for passive elongation) or dynamic (controlled elongation or contraction) tension; the variation can occur prior to or during the activity;

(e) Dynamics—the support member can be stationary or moving. Moving support members could be in one direction or reciprocating directions.

Ways to alter object movement through varying the resilient member characteristics may be as follows:

(a) Oscillation—the oscillation of the object can be achieved: passively (rubber, springs, counter weight, dampers etc.) or mechanically (hydraulically, winch, motors, engines etc.). The oscillation can be controlled directly or remotely by the object/user or an external control (an operator).

(b) Number—the object can be attached to the support line/coupling member via one or more connections.

(c) Length—the length of the resilient member can be static or dynamic. The length can be altered prior to or during movement of the object.

(d) Stiffness/elasticity—the stiffness of the resilient member can be static or dynamic. The stiffness can be altered prior to or during movement.

(e) Composition—the resilient member can be composed of one or more materials, in series and/or parallel, and/or oscillation mechanisms.

(f) Internal damping—the hysteresis and internal damping of the resilient member material can be varied.

Movement characteristics of the object may be tuned by altering the at least one coupling member characteristics. Ways to alter object movement by varying the coupling member may be as follows:

Tuning of the coupling member to alter the movement characteristics may be achieved as follows:

(a) Number—the activity can be achieved through one or more coupling members, with one or more wheels, carrying one or more objects (e.g. riders) on one or more support members or resilient members.

(b) Mass—the dynamics of movement may be significantly affected by the coupling member mass. The mass of the coupling member can be altered to provide variation to the movement. This could include altering the mass of coupling member to suit the mass of the object or allowing the object/rider to select the coupling member mass to achieve a different experience. The mass of the coupling member can be altered by adding or removing mass, or having multiple coupling member of varying mass.

(c) Length—the dynamics of movement are significantly affected by the coupling member length. The length of the coupling member can be altered to provide variation to movement. This could include altering the length of coupling member to suit the mass of the object or allowing the object/rider to select the coupling member length to achieve a different experience. The length of the coupling member can be altered by adding or removing length, or having multiple coupling members of varying length.

(d) Connections to the member/line—the dynamics of movement are significantly affected by the coupling member's connection to the support member. The coupling member can be connected dynamically (wheels, sliders etc.) statically (clamps, hooks etc.) or magnetically (passive or electromagnetism).

(e) Coupling member control—the coupling member can be free to move due to momentum or can be provided with controls to alter the coupling member's velocity and acceleration. This may be achieved: passively (friction, wind resistance, internal drag, etc.); with brakes (controlled (active) or self-regulating (passive)); via a powered system (motors, engines etc.); or, through stored energy (flywheel, spring, magnetics etc.). Control of the coupling member can be achieved by the object (user) and/or external controller such as an operator and/or an observer and can be directly and/or remotely controlled.

The at least one object may be coupled to the at least one resilient member via: at least one harness; at least one carriage; at least one trolley; and combinations thereof. Linking the object such as a person to the member is clearly critical for safety and comfort during movement.

Movement may be concluded by capture of the at least one object. Object capture may return the object to a point selected from:

(a) Location—the object/rider can complete movement at the point which they started or at a point remote to the initial starting position;

(b) Height—the object/rider can complete the activity above, below or at the height of detachment. If the object/rider is above or below the height of detachment a separate mechanism can be used to raise or lower the object/rider accordingly;

(c) Attachment—the object/rider can complete movement by staying attached to the coupling member and/or lines until they are grounded, or detaching before they are grounded and providing a freefall to a safe catching point (net, water, foam pit etc.).

In a second aspect, there is provided a method of moving an object through space in a controlled manner by the steps of:

(a) selecting an apparatus substantially as described above;

(b) attaching at least one object to the at least one resilient member;

(c) energising the at least one resilient member;

(d) initiating movement of the at least one object; and (e) allowing movement of the at least one object in both a vertical y-axis direction via the at least one resilient member, and a set path direction via the at least one support member.

As may be apparent from the above description, the apparatus and method described allow controlled object movement in at least two directions. Art controlled movement apparatus typically only allow for movement in one primary direction—for example, a bungee line that controls movement in a vertical y-axis. The apparatus described herein introduces a wider variety of movement sensations on the object such as high acceleration and deceleration; suspension at height; gliding; swinging and bouncing. This is however provided for in a comparatively safe and tuneable prescribed path of motion.

The embodiments described above may also be said broadly to consist in the parts, elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as of individually set forth, Where specific integers are mentioned herein which have known equivalents in the art to which this invention relates, such known equivalents are deemed to be incorporated herein as if individually set forth.

WORKING EXAMPLES

The above apparatus and method are now described by reference to specific examples.

Example 1

Referring to FIGS. 3 to 10, an embodiment is shown of one embodiment of the above described apparatus.

Figure 3:
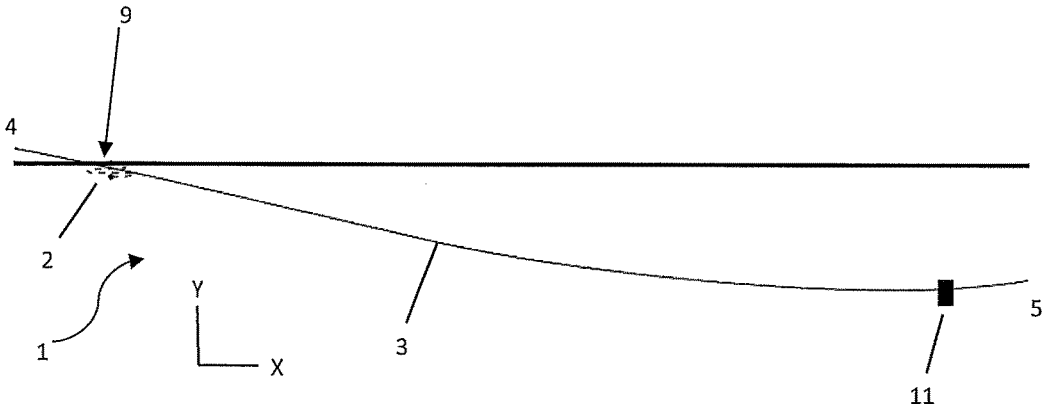
FIG. 3 illustrates an embodiment of the apparatus with the object energised and ready for movement initiation caused by gravity.

FIG. 3 illustrates the apparatus 1 with the object 2 energised and ready for movement initiation. The apparatus 1 comprises a support line 3 in the form of a substantially non-resilient cable, the cable being attached at either end 4, 5 and forming a U-shape side profile. One end 4 of the support line 3 is higher than the opposing end 5 of the support line 3.

A resilient line 6 in the form of a rubberised cord is coupled to the support line 3 via a coupling member 7 (a zipline trolley).

In the energised position of FIG. 3, the object 2 is approximately level with the support line 3 and the rubberised cord 6 is in a relaxed and un-tensioned state.

Figure 4:
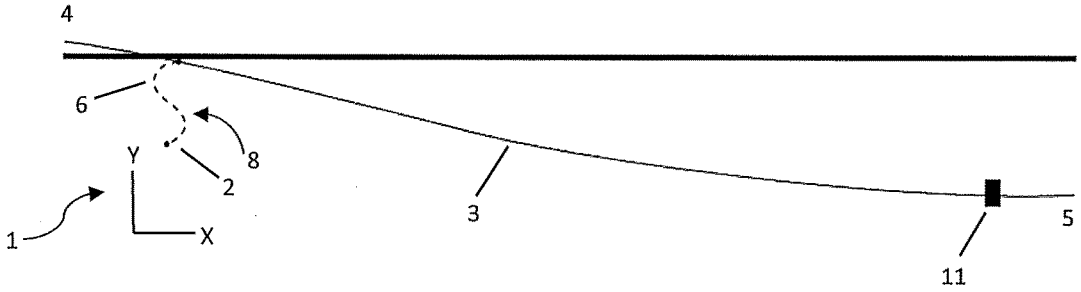
FIG. 4 illustrates the object commencing movement.

FIG. 4 shows the object 2 commencing movement. The path 8 of the object 2 through space is shown by the dotted line 8. Initially only vertical drop movement in the y-axis occurs, the zipline trolley 7 starting to move from a stop position 9 as the rubberised cord 6 reaches a maximum extension 10.

Figure 5:
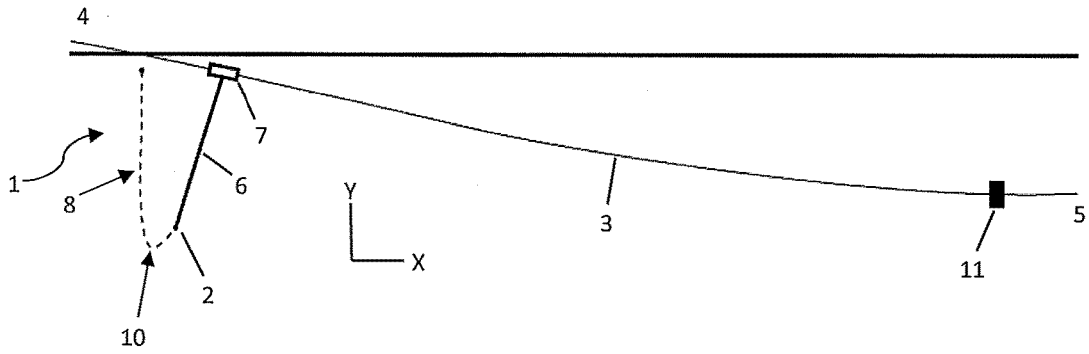
FIG. 5 illustrates a point of maximum extension in a vertical y-axis direction.

FIG. 5 shows the point of maximum extension 10 and how the zipline trolley 7 has begun movement along the support line cable 3 in the x-axis direction.

Figure 6:
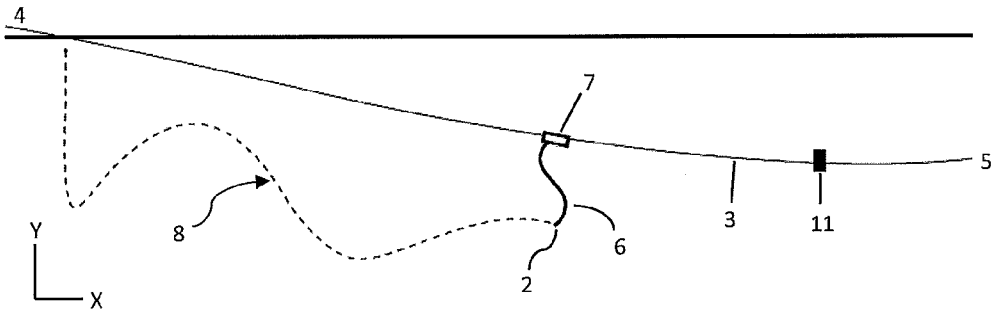
FIG. 6 illustrates the path of movement of the object a step further along the trajectory.

FIG. 6 shows the path of movement of the object 2 a step further along the movement path 8.

Figure 7:
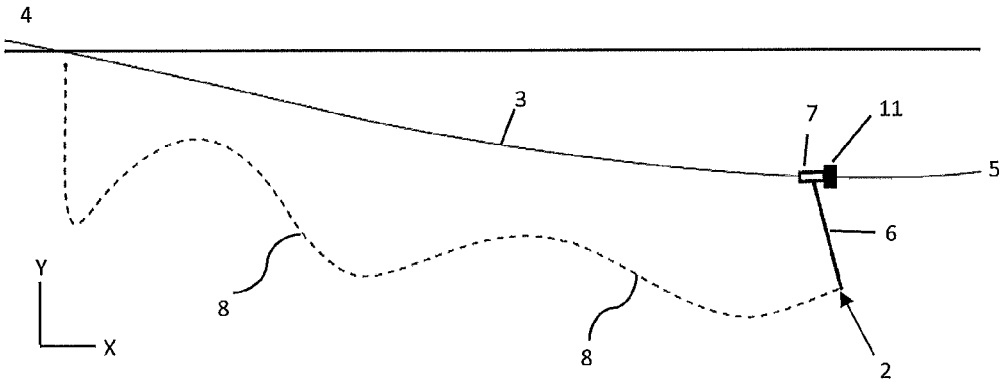
FIG. 7 illustrates the coupling member striking a stop or re-direction point.
Figure 8:
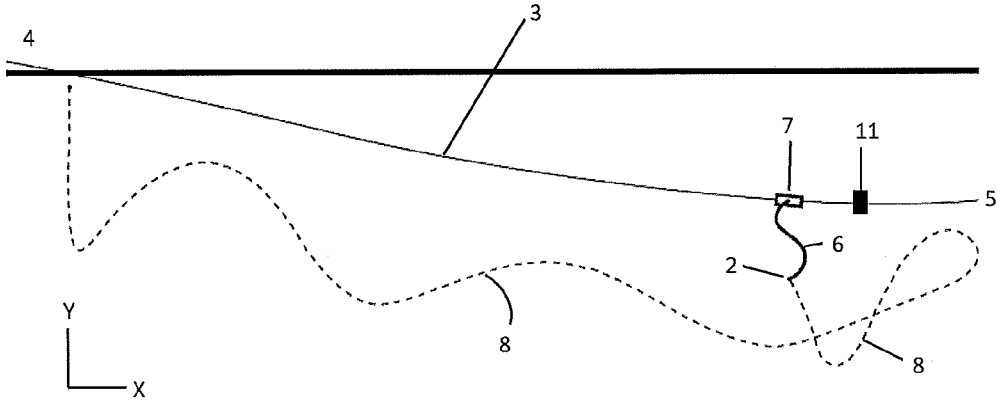
FIG. 8 illustrates the subsequent swinging action of the object causing the coupling member to reverse x-axis movement.

FIG. 7 shows the zipline trolley 7 striking a stop 11 or re-direction point. The stop 11 halts motion of the zipline trolley 7 and subsequent swinging action of the object 2 then causes the zipline trolley 7 to reverse x-axis movement as shown in FIG. 8.

Figure 9:
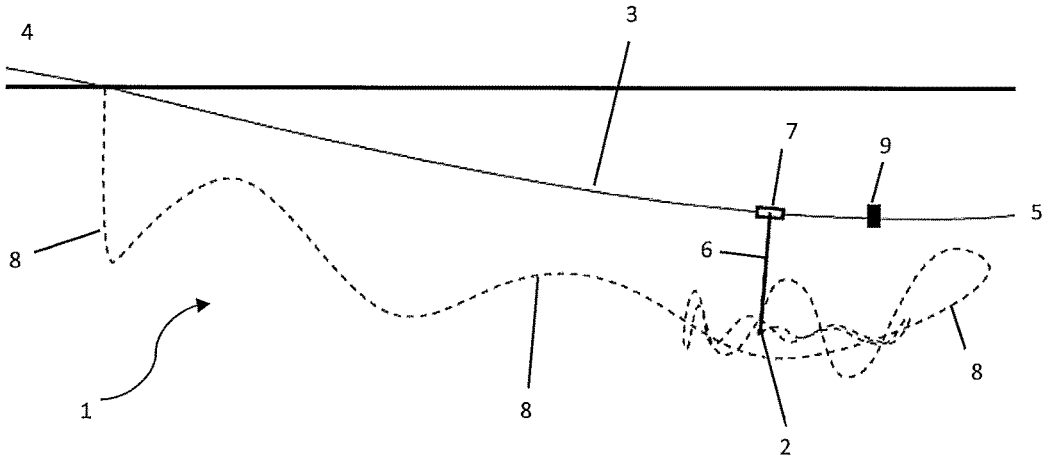
FIG. 9 illustrates a full path of motion for the object.

A full path of motion is shown in FIG. 9 of the object 2 based on the modelled criteria used in the example. In practice, the object 2 may be captured (not shown) prior to the full cycle of movement shown in FIG. 9 and movement slowed or halted before the full range of motion illustrated.

As should be appreciated, the movement path 8 may be varied by altering a range of characteristics including object 2 parameters (weight for example), characteristics of the resilient line 6, characteristics of the zipline trolley 7 and characteristics of the support line 3.

Figure 10:
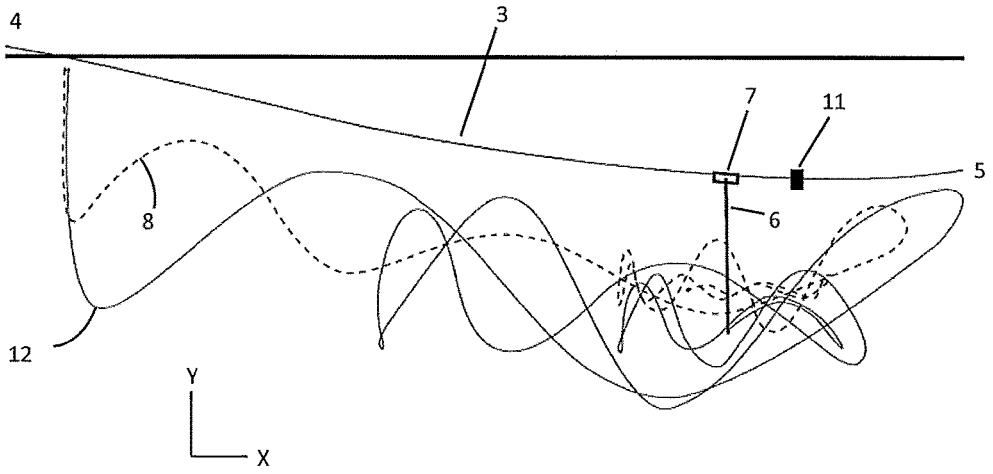
FIG. 10 illustrates a comparison full path of motion for a heavier weight object than the object shown in FIG. 9.

To illustrate this point, FIG. 10 shows the movement path 12 of a heavier object using the same line 3 and trolley 7 characteristics as used above.

Ways to tune the characteristics are described in more detail in the detailed description above.

Example 2

Example 1 relied on gravity only to energise and cause movement of the object 50. In this example, and referring to FIGS. 11 to 13, an additional force generating mechanism is used to impart a horizontal x-axis force on the object 50 at initiation—this could be a resilient line energising mechanism or other device. Use of an additional force like this may alter the object 50 movement path—for example, if the object 50 is a person, to heighten the feeling of flight or gliding movement.

Figure 11:
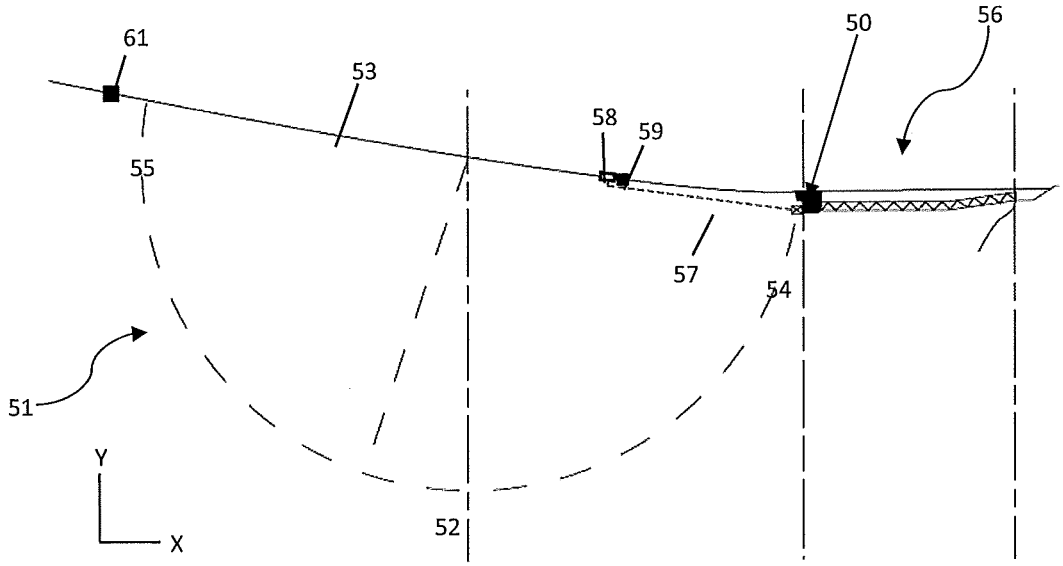
FIG. 11 illustrates an alternative embodiment of apparatus in an energised state with a mechanism used to impart additional force on the object.

FIG. 11 shows the apparatus 51 in a recreation embodiment, in energised state above a piece of terrain 52 such as a valley. A support cable 53 runs from one side 54 of the valley 52 to the other side 55. The apparatus 51 includes a launch site 56, the object 50, in this example being a person or rider 50, attached to one distal end of a resilient line 57. The resilient line 57 at the opposing end is attached to a zipline trolley 58, trolley 58 movement towards the launch site 56 being blocked by a stop 59. The rider 50 and opposing end of the resilient line 57 are drawn back towards the launch site 56 via a retraction means (not shown) thereby energising the resilient line 57. In addition, the rider 50 is located at a height about level with the support line 53 thereby also imparting gravitational potential energy to the rider 50.

Figure 12:
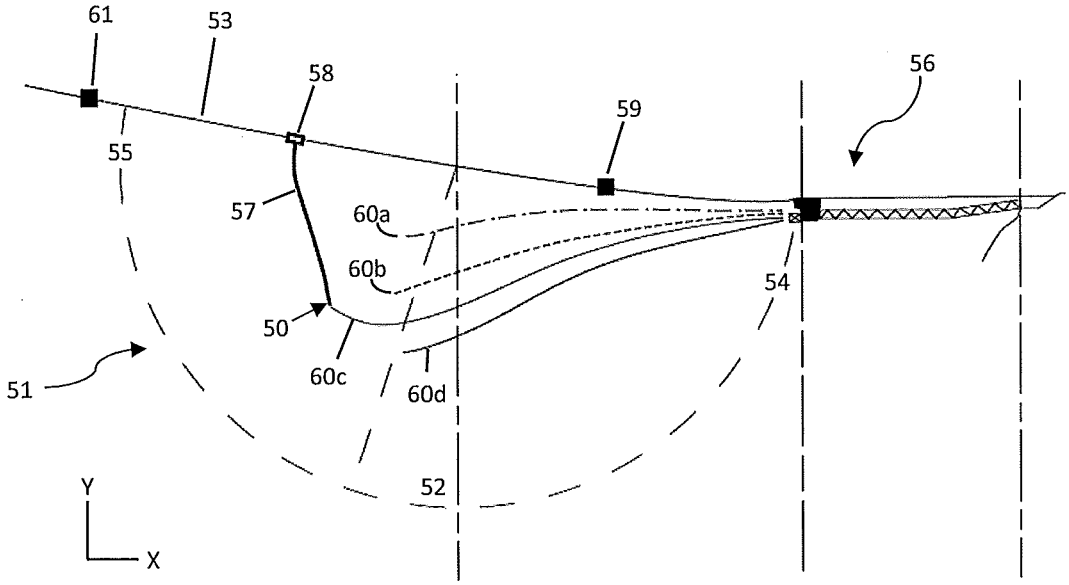
FIG. 12 illustrates the initial movement path of the object post movement initiation with different object weight paths illustrated.

FIG. 12 shows the path 60 (60*a*, 60*b*, 60*c*, 60*d* depending on rider 50 weight) of the rider 50 once movement is initiated, in this case presenting a flatter path 60 characterised by a longer x-axis movement than that of Example 1.

Figure 13:
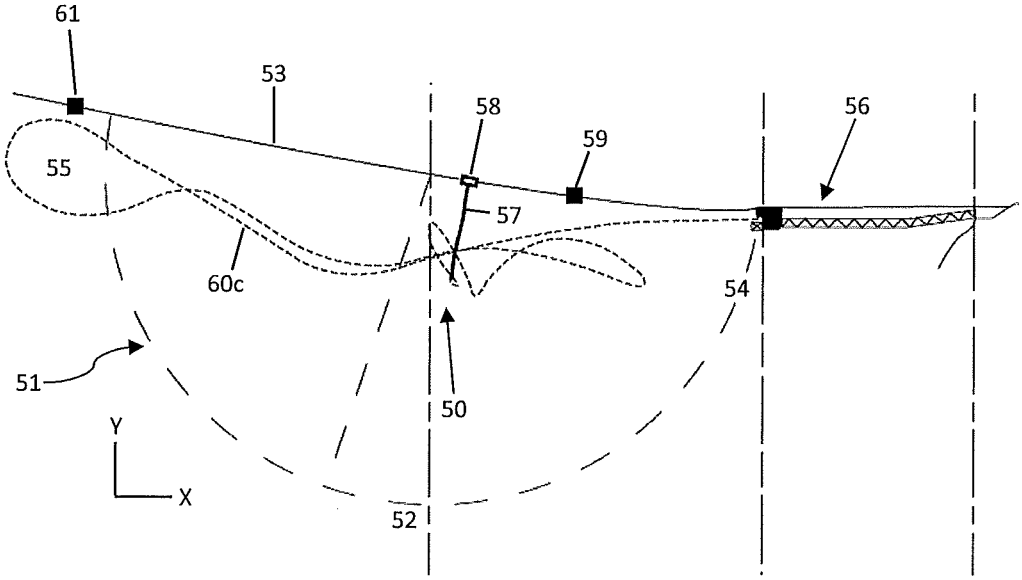
FIG. 13 illustrates an eventual full movement path of the object in the alternative embodiment based on one object weight.

The eventual full movement path 60 of the rider 50 is shown in FIG. 13.

Example 3

In this example a bungee/zipline jump human amusement application is described in more detail referring to FIGS. 14 to 20.

Figure 14:
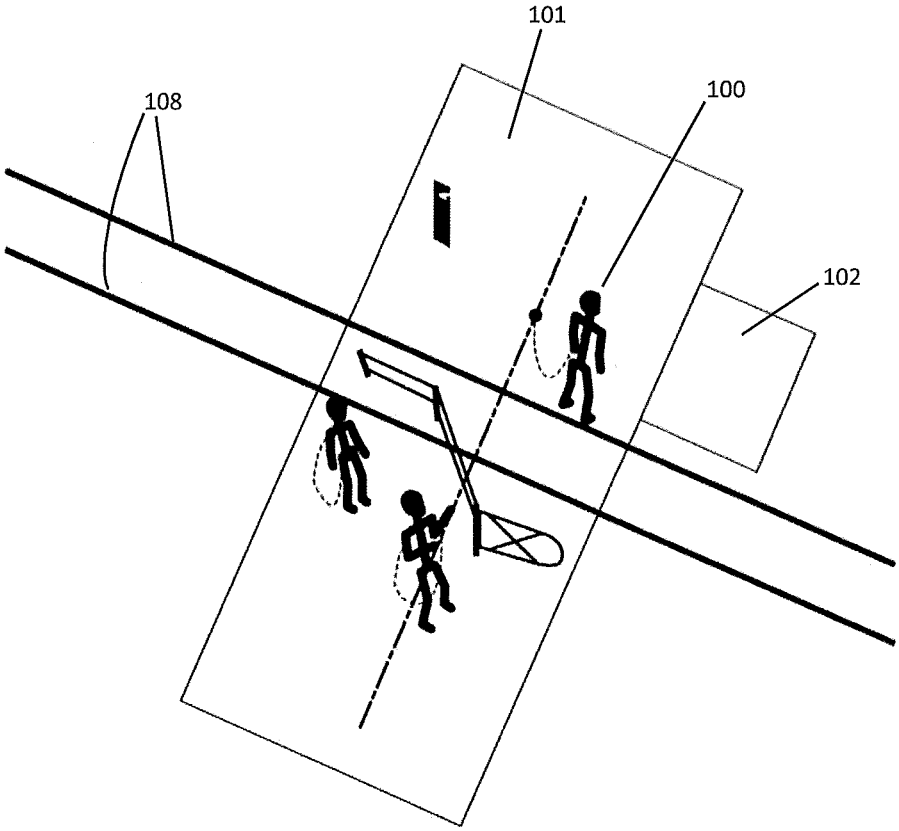
FIG. 14 illustrates the participant safely positioned at the left hand side of the launch platform away from the jump area.

In FIG. 14, the participant 100 is safely positioned at the left hand side of the launch platform 101 away from the jump area 102.

Figure 15:
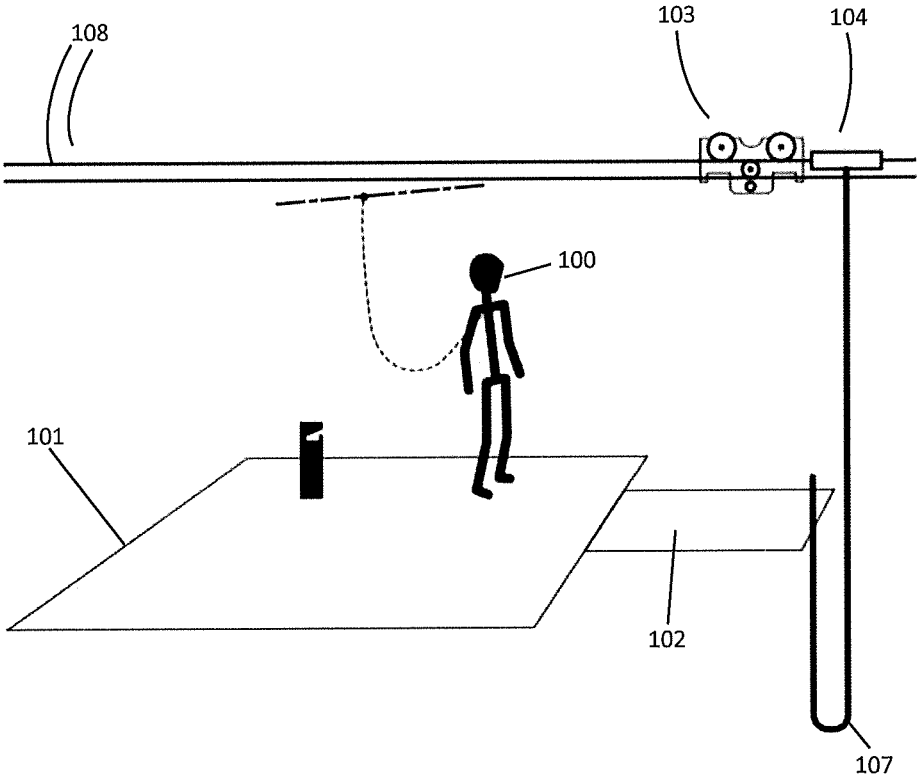

FIG. 15 shows the energiser trolley 103 and rider trolley 104 being positioned at the launch platform 101 and prepared for the participant 100 to connect with.

Figure 16:
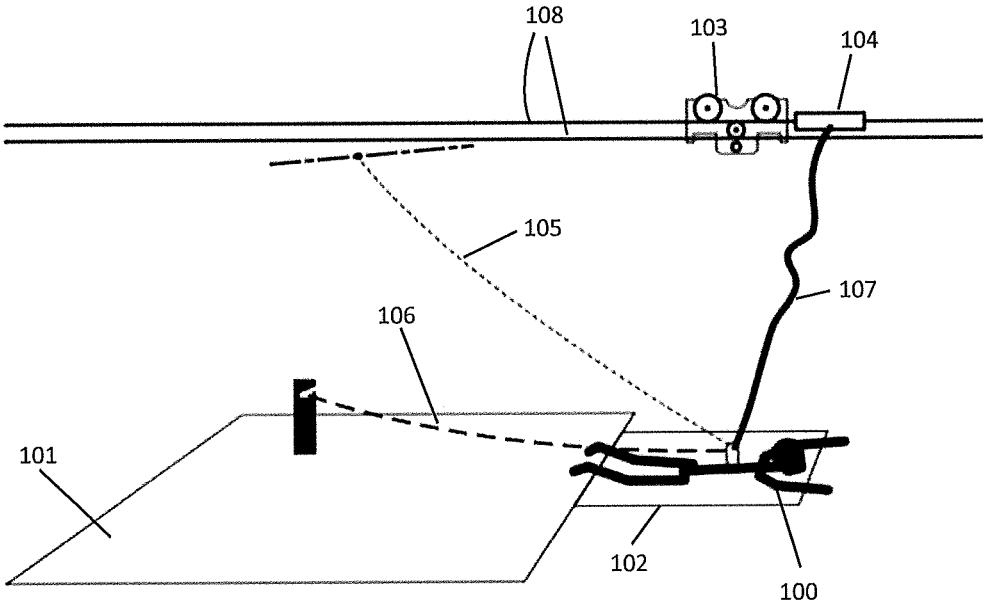
FIG. 16 illustrates the participant being secured into the activity, while remaining safely secured to the platform, through a safety leash, quick release (with redundancy) leash, and bungee cable.

FIG. 16 shows the participant 100 being secured into the activity, while remaining safely secured to the platform 101, through a safety leash 105, quick release (with redundancy) leash 106, and bungee cable 107.

Figure 17:
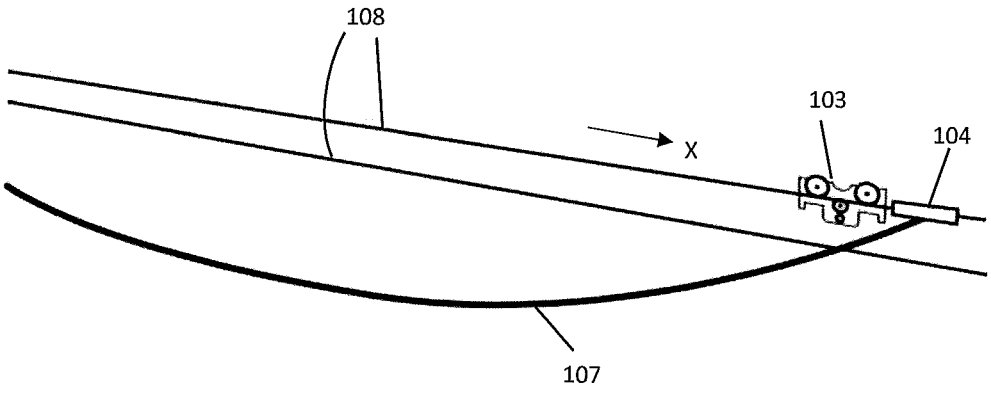
FIG. 17 illustrates the energiser trolley and rider trolley being moved along overhead cables in direction X away from the participant to a pre-determined position, imparting elastic energy into the bungee cable.

FIG. 17 illustrates the energiser trolley 103 and rider trolley 104 being moved along overhead cables 108 in direction X away from the participant 100 to a pre-determined position, imparting elastic energy into the bungee cable 107.

Figure 18:
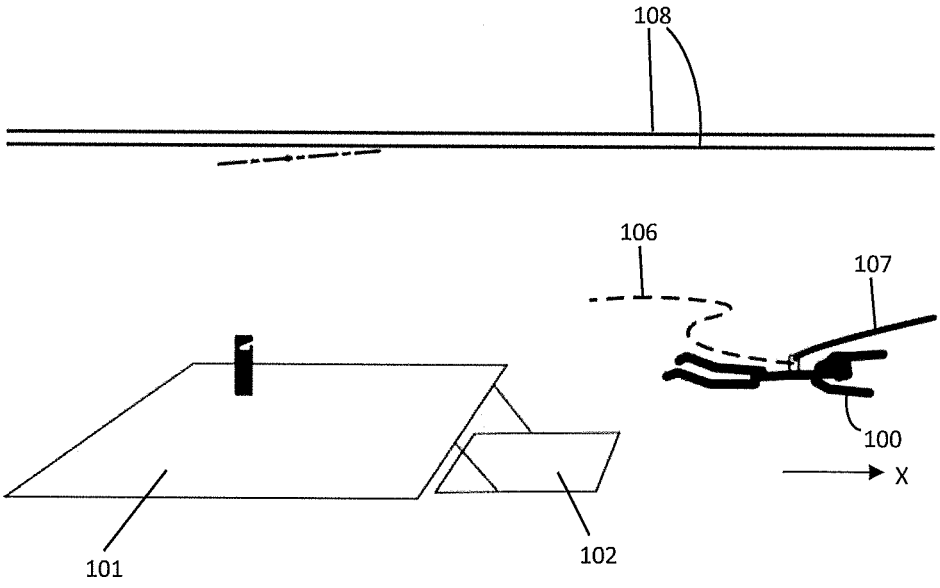
FIG. 18 illustrates the first action as the participant is released, and the stored elastic energy causes the participant to launch in direction X.

FIG. 18 illustrates the first action as the participant 100 is released, and the stored elastic energy causes the participant 100 to launch in direction X.

Figure 19:
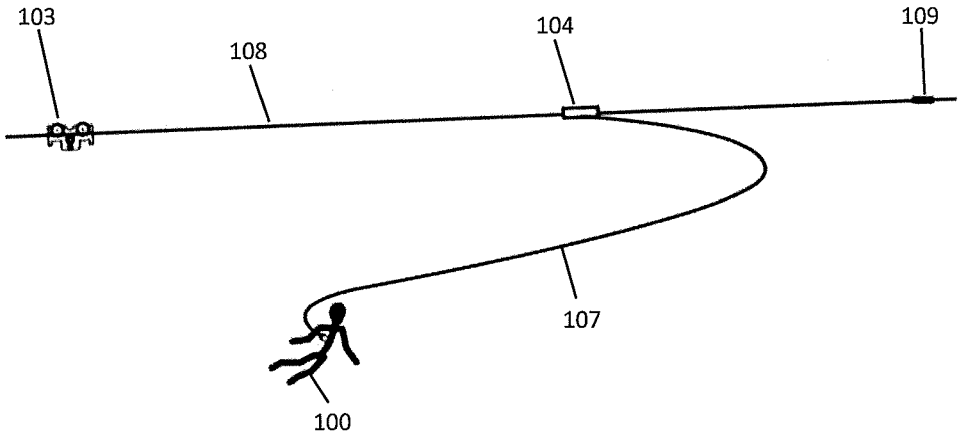
FIG. 19 illustrates how the participant's momentum causes the rider trolley to move along the cables until either the trolley reaches a hard stop located on the cables or gravity causes the participant to stop.

FIG. 19 shows how the participant's 100 momentum causes the rider trolley 104 to move along the cables 108 until either the trolley 104 reaches a hard stop 109 located on the cables 108 or gravity causes the participant 100 to stop.

Figure 20:
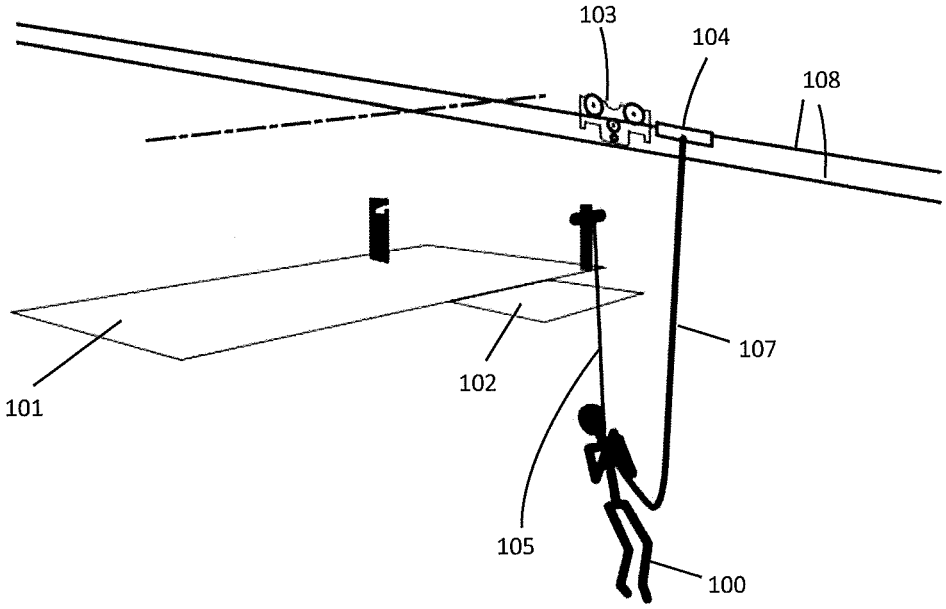
FIG. 20 illustrates an example retrieval system, similar to that used on art bungee jumps, that retracts the participant back to the platform, where there activity can be reset.

Eventually, gravity will urge the rider trolley 103 to reconnect with the energising trolley 104 at which point the participant 100 can be recovered. FIG. 20 shows an example retrieval system, similar to that used on art bungee jumps, that retracts the participant 100 back to the platform, where the activity can be reset.

Example 4

In this example, prototype testing is described using a test rig with similar functionality to that depicted in Example 3 however, for the purposes of testing, simulated weights using objects were used instead of people as participants. The simulations of Examples 1 and 2 are helpful but may omit or assume some details that are impossible or very difficult to simulate from real life. These omissions and assumptions can contribute to variation between the expected and observed test results however do not compromise the goal or purpose of the testing.

Figure 21:
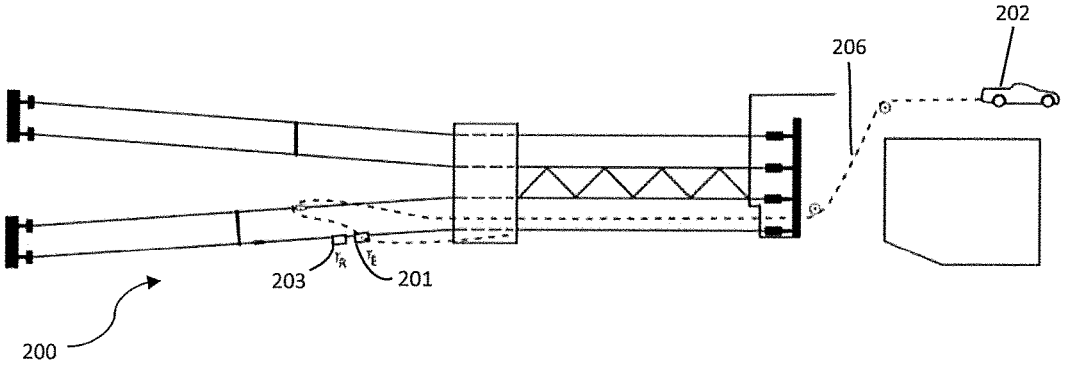
FIG. 21 illustrates a plan view of a test apparatus used to trial the system.
Figure 22:
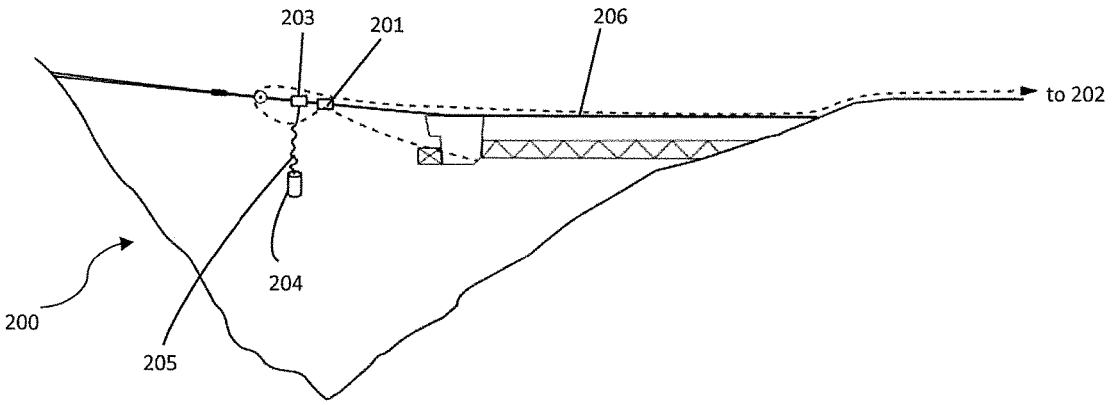
FIG. 22 illustrates side elevation view of a test apparatus used to trial the system.

To provide proof-of-concept testing, the setup 200 shown in FIGS. 21 (plan view) and 22 (side elevation) was developed. The setup 200 used an energiser trolley 201, connected to a vehicle 202, to position the free-running rider trolley 203. The setup 200 also uses an object 204 attached to an elastic line (bungee cord) 205 which in turn is attached to the rider trolley 203.

As noted above, the participant in the trial was an object 204 with a range of representative test masses. These masses were provided by a combination of data acquisition equipment and a container, the container being either a barrel providing a launch weight of 38 kg, or a drum—providing a launch weight of 85 kg, with the ability to be ballasted to 135 kg with water.

Two bungee cords 205 were used, each with a length of 20 m from the eye. These cords 205 were constructed as:

- Cord 1 (light cord): consisting of 22 ply (1200 strands) rubber and an expected average spring constant of 62.1 N/m;
- Cord 3 (heavy cord): consisting of 46 ply (1200 strands) rubber and an expected average spring constant of 99.4 N/m.

Two identical trolleys 201, 203 were designed and fabricated being the energiser trolley 201 and rider trolley 203. The two trolleys 201, 203 used magnetic attraction between them to provide a connection for positioning and retracting the rider trolley 203. The rider trolley 203 is a free-running trolley that dynamically interacts with the rider's 204 momentum to provide a particular trajectory and experience. The energiser trolley 201 positions the rider trolley 203 at the initiation of the activity and recovers the rider trolley 203 at the end of the activity.

Test equipment used included a tri-axial accelerometer placed as close as possible to the centre of mass as measured along the bungee line axis. A set of yaw, pitch and roll rate transducers were also arranged on a steel bracket mounted near the accelerometers.

Video recording and image tracking was used as the primary means to determine the trajectory profile. A mix of digital cameras were used side on and at other angles to record various aspects of the testing.

The mechanism used to control the position of the energiser trolley 201, and subsequently the tension within the bungee cord 205, was a vehicle 202 directly tethered to the energiser trolley 201 through an energising line 206, shown in FIG. 21. Prior to the initiation of a test, the energising line 206 was attached taught to the vehicle 202. An appropriate distance was estimated in front of the vehicle 202 to account for line 206 slack and line stretch.

The length of displacement of the energiser trolley 201 was independently measured with markings on the energising line 206. The tension on the energised bungee 205 line was measured.

Five tests were conducted, varying the cord used, the rider mass, and the amount of total extension in the bungee 205 (comprising of the bungee initial length, any slings attached and bungee stretch). Table 1 below shows a detailed breakdown of the test matrix.

TABLE 1

Test matrix of the completed full scale test program.

| | Initial Conditions | | | | |
|---|---|---|---|---|---|
| | Line Details | | System Mass | | Bungy Line |
| Test ID | Cord detail | Length [m] | Rider [kg] | Trolley [kg] | Extension [m] |
| Test 1 | Cord 1 | 20 m | 85 kg | 20 kg | 55 m |
| Test 2 | Cord 1 | 20 m | 38 kg | 20 kg | 40 m |
| Test 3 | Cord 3 | 20 m | 38 kg | 20 kg | 40 m |
| Test 4 | Cord 3 | 20 m | 85 kg | 20 kg | 52 m |
| Test 5 | Cord 3 | 20 m | 135 kg | 20 kg | 70 m |

Expected Observations

Figure 23:
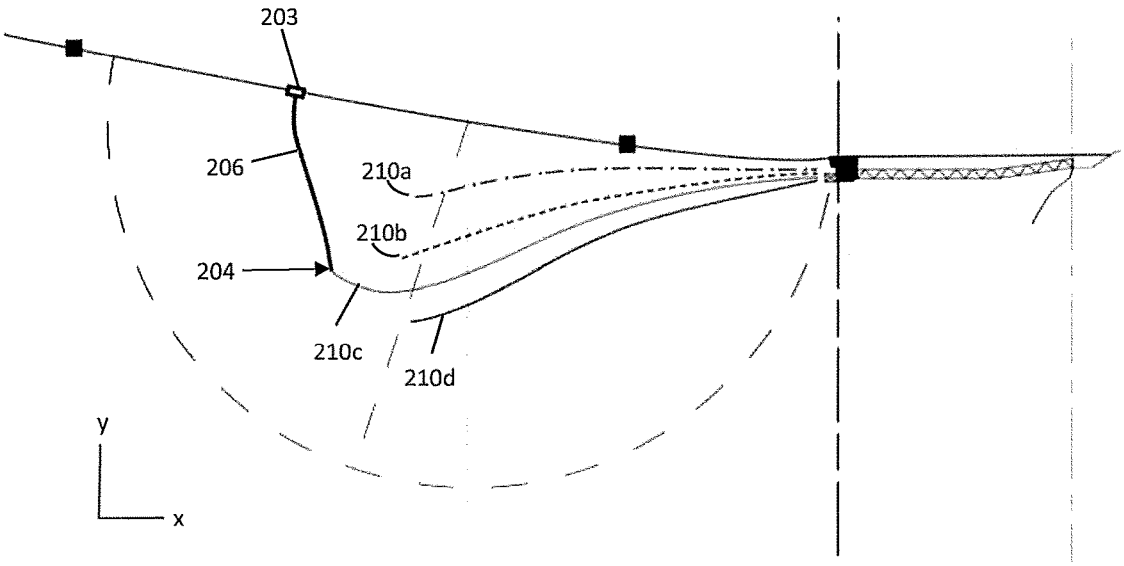
FIG. 23 illustrates predicted initial launch motion profiles of 35 kg, 70 kg, 100 kg, and 135 kg masses with 3.2× line stretch (70 m) after approximately 5 seconds using the test apparatus.

The simulation tool was used to predict the forces and kinematics expected from the full scale testing. An example of the expected kinematics for various masses launched when the bungee 205 is stretched to 3.2× its relaxed length is shown in FIG. 23 where the drawing shows the predicted initial launch motion profiles 210*a*, 210*b*, 210*c*, 210*d* of 35 kg, 70 kg, 100 kg, and 135 kg masses with 3.2× line stretch (70 m) after approximately 5 seconds.

The commercial activity is based on limiting the participant mass from 45 kg to 127 kg, matching art bungee operating ranges. To account for potential over weight and underweight situations this testing program looked to investigate masses ranging from 35 kg to 135 kg.

Measured Launch Forces

A load cell was placed inline with the bungee cord to measure the launch and line conditions. The load cell was used to measure the force contained in the stretched bungee. At the moment of launch, this force was transferred directly onto the test mass and used to accelerate it. This measured force was used as the primary measurement for the acceleration applied to the mass. Table 2 below shows the measured force from the bungee prior to the moment of launch. This force is used to calculate a launch acceleration on the test mass and an approximate linear spring rate for the bungee line.

TABLE 2

The test conditions during the field trials.

| | Initial Conditions | | | Launch Conditions | | | |
|---|---|---|---|---|---|---|---|
| | Line Details | | Rider Details | Bungy Line | Measured | Calculated | Approximate |
| Test ID | Cord detail | Free Length [m] | Mass [kg] | Extension [m] | Force [N] | Acceleration [g's] | Spring Rate [N/m] |
| Test 1 | Cord 1 | 20 | 85 | 55 | 2325 | 2.79 | 42.3 |
| Test 2 | Cord 1 | 20 | 38 | 40 | 1410 | 3.78 | 35.3 |
| Test 3 | Cord 3 | 20 | 38 | 40 | 3380 | 9.07 | 84.5 |
| Test 4 | Cord 3 | 20 | 85 | 52 | 4420 | 5.30 | 85.0 |
| Test 5 | Cord 3 | 20 | 135 | 70 | 5320 | 4.02 | 76.0 |

Test Weight Trajectory

To mark the trajectory of each trial, a high definition side view camera captured the launch and the position of the weight was tracked by marking each video frame. The results of the trajectory 300*a-e* marking are shown in FIGS. 24 to 28, with the travel path of the test mass shown.

Figure 24:
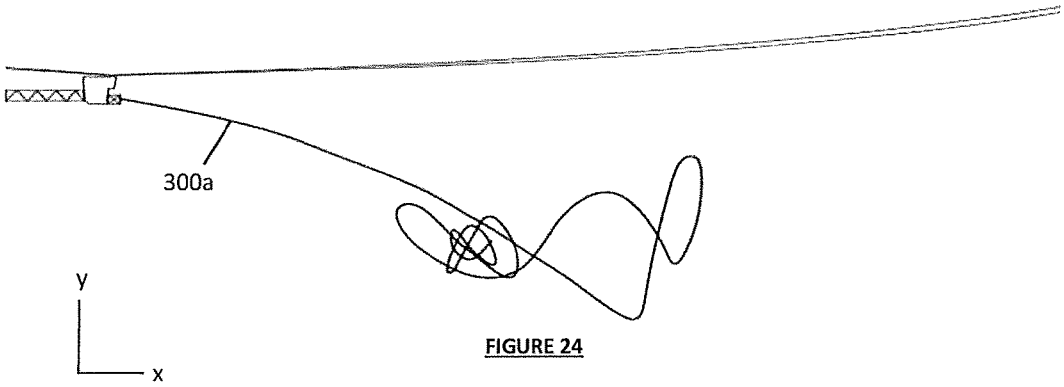
FIG. 24 illustrates the trial 1 trajectory of a first cord (cord 1) (Light Cord)—85 kg stretched 55 m.

FIG. 24—Trial 1 trajectory 300*a*—Cord 1 (Light Cord)—85 kg Stretched 55 m.

Figure 25:
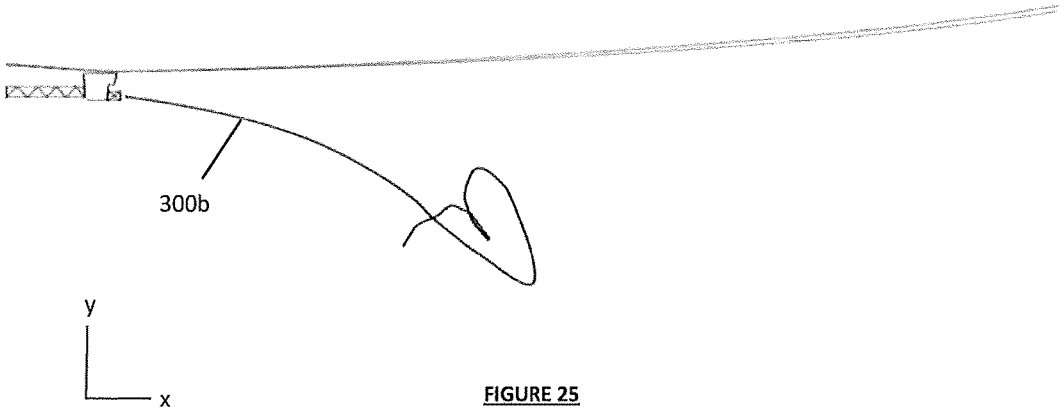
FIG. 25 illustrates the trial 2 trajectory of a first cord (cord 1) (Light Cord)—38 kg stretched 40 m.

FIG. 25—Trial 2 trajectory 300*b*—Cord 1 (Light Cord)—38 kg Stretched 40 m.

Figure 26:
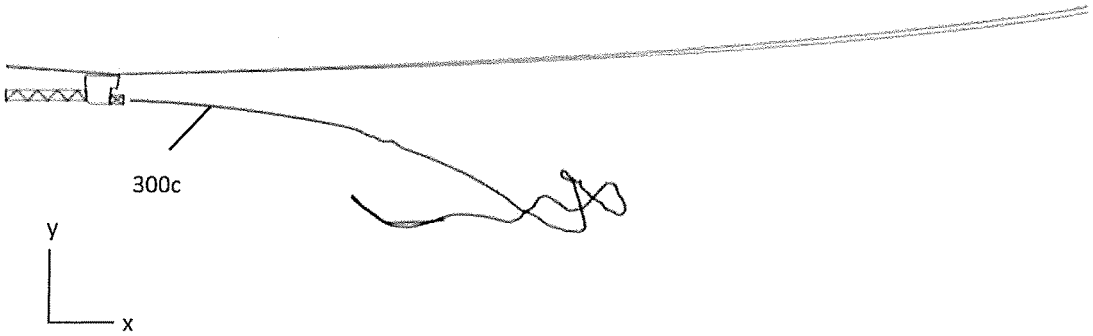
FIG. 26 illustrates the trial 3 trajectory of an alternative cord (cord 3) (Heavy Cord)—38 kg stretched 40 m.

FIG. 26—Trial 3 trajectory 300*c*—Cord 3 (Heavy Cord)—38 kg Stretched 40 m.

Figure 27:
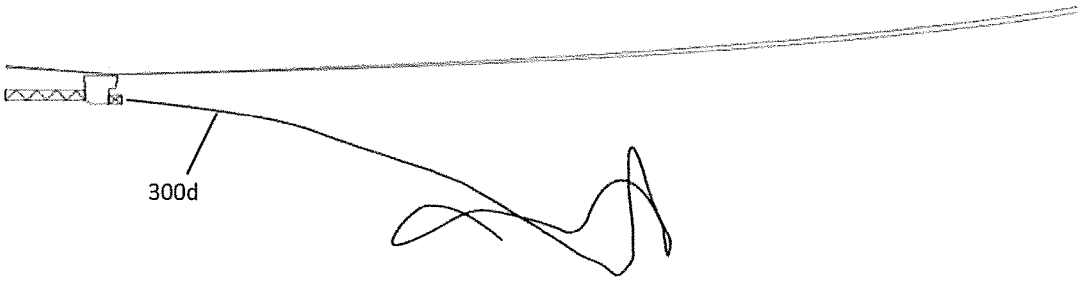
FIG. 27 illustrates the trial 4 trajectory of an alternative cord (cord 3) (Heavy Cord)—85 kg Stretched 52 m.

FIG. 27—Trial 4 trajectory 300*d*—Cord 3 (Heavy Cord)—85 kg Stretched 52 m.

Figure 28:
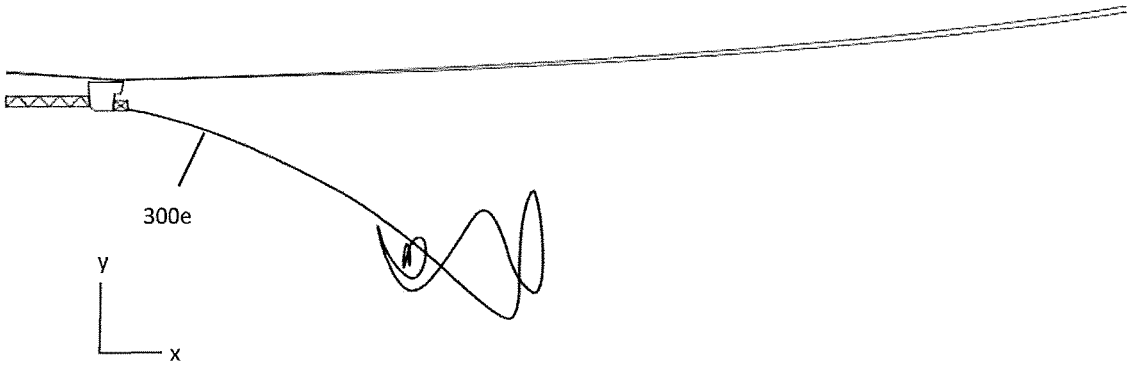
FIG. 28 illustrates the trial 5 trajectory of an alternative cord (cord 3) (Heavy Cord)—135 kg Stretched 70 m.
Figure 29:
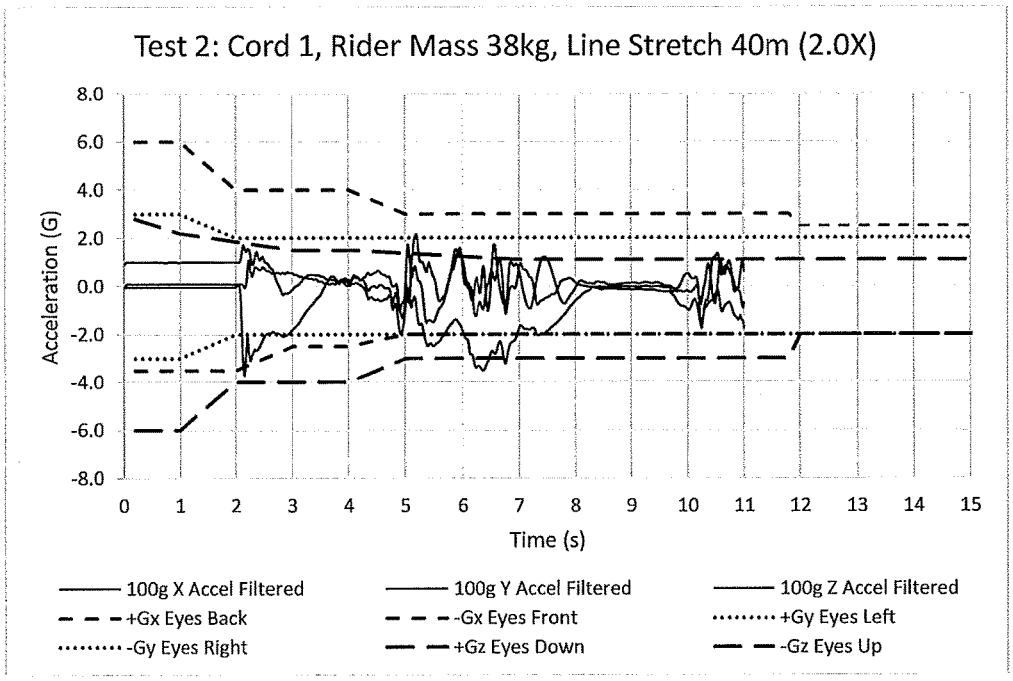
FIG. 29 illustrates a graph of the measured acceleration-duration profile for Test 2.
Figure 30:
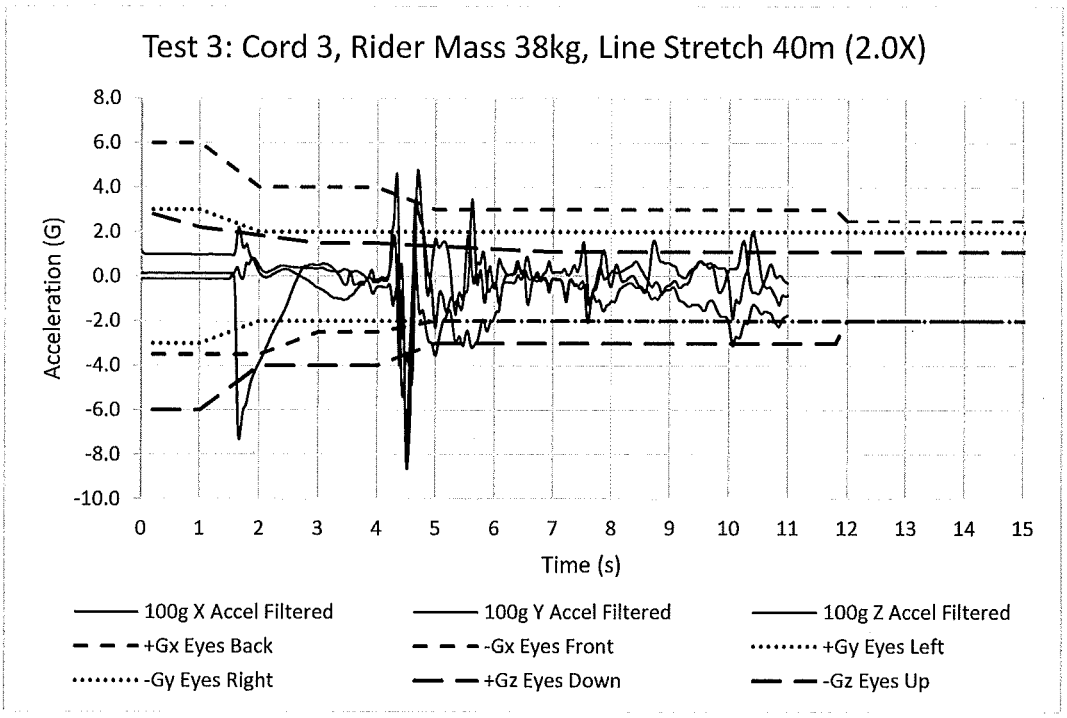
FIG. 30 illustrates a graph of the measured acceleration-duration profile for Test 3.
Figure 31:
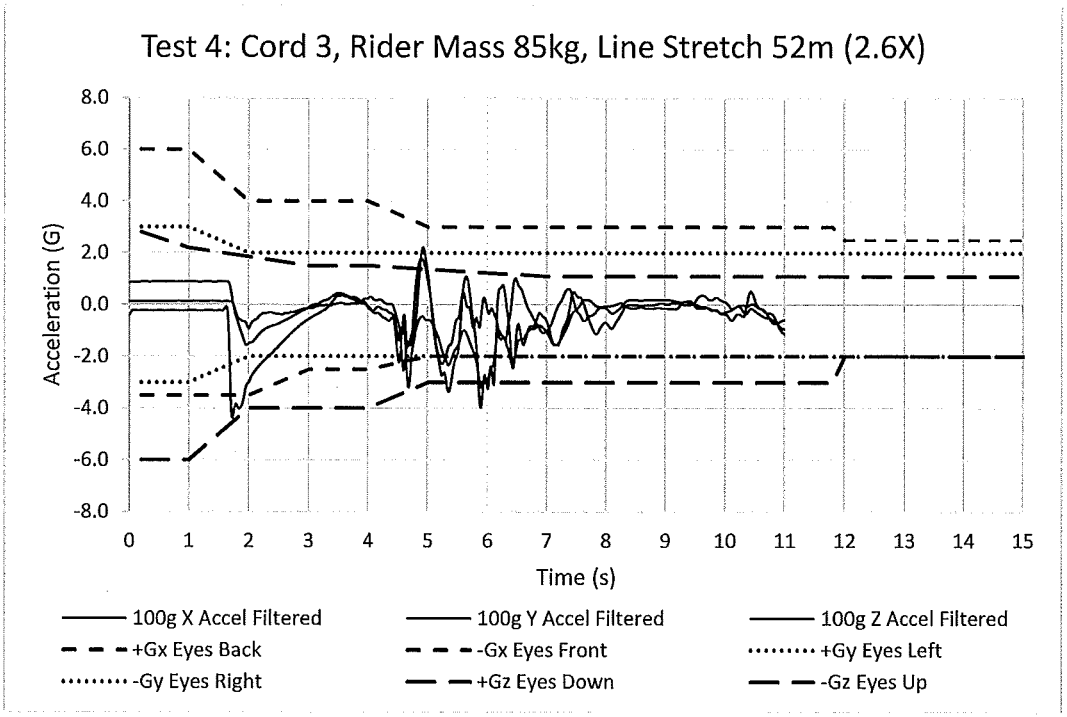
FIG. 31 illustrates a graph of the measured acceleration-duration profile for Test 4.
Figure 32:
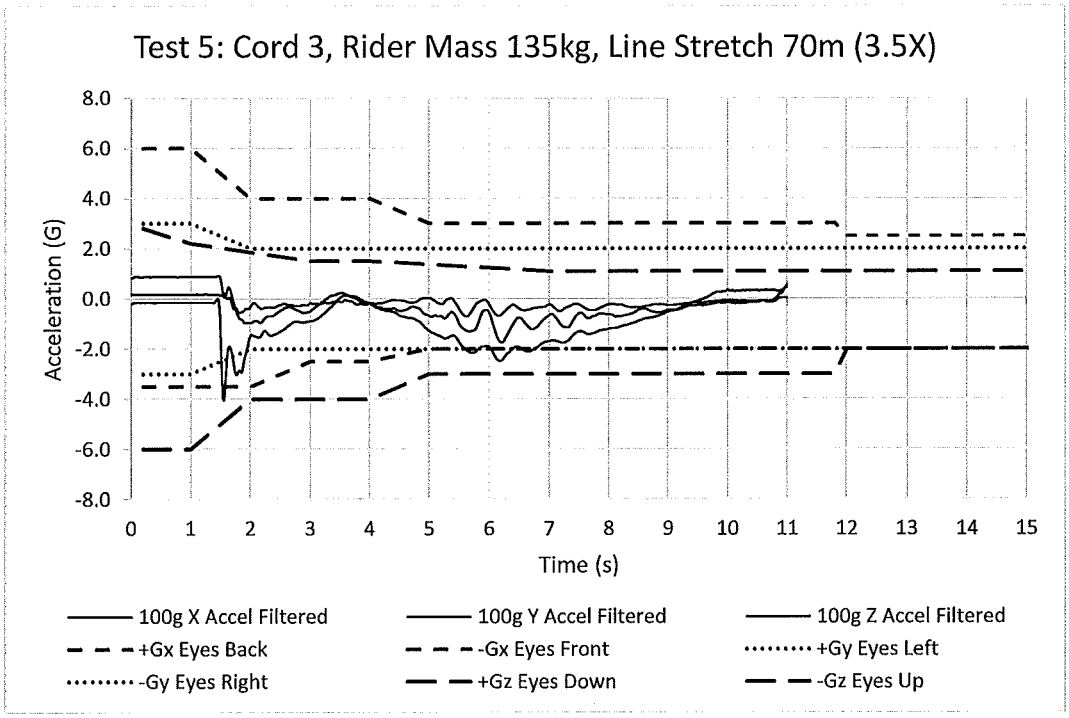
FIG. 32 illustrates a graph of the measured acceleration-duration profile for Test 5.

FIG. 28—Trial 5 trajectory 300*e*—Cord 3 (Heavy Cord)—135 kg Stretched 70 m.

The validation tool required many engineering assumptions and estimates to predict the performance of the conceptual activity. One of the main engineering estimates during the creating of the simulation model was the spring rate of the bungee cord. As previously identified, a linear spring rate was estimated for each cord. To validate this estimate, a load cell was placed inline with the bungee cord to measure the force exerted while the cord was stretched. The measured bungee cord spring rates are shown in FIG. 51. The estimated spring rates were consistently higher than the measured spring rates.

To validate the accuracy of the simulation model, there are two key performance requirements:

a) that the model is capable of predicting the overall trajectory of the test weight, and
b) the general kinematics and dynamics seen during the test are accurate.

The accuracy of the simulation model was determined by comparing the simulation model to the analysed video.

A direct comparison of the experimental trials against the simulation model trajectory paths was completed. The trajectories and performance profiles from the simulation model were found to reasonably match the measurements obtained during testing.

Acceleration

Figure 2:
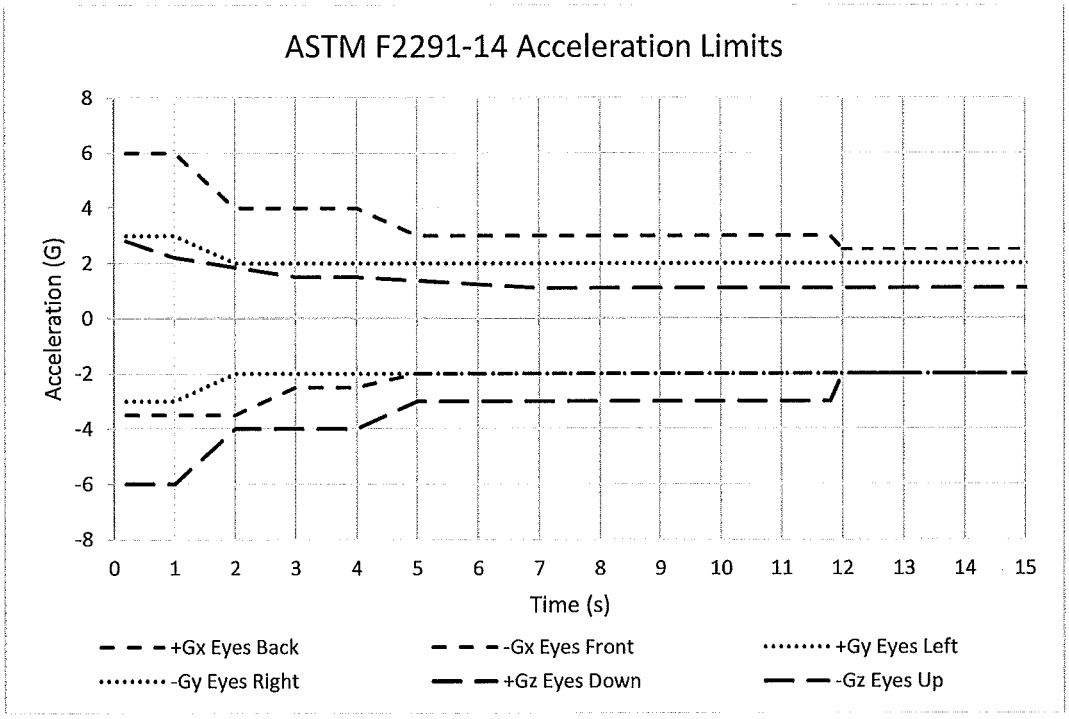
FIG. 2 illustrates ASTM acceleration-duration limits for amusement devices.

The acceleration limits provided in ASTM F2291-14 for each orthogonal axis were shown in FIGS. 1 and 2 as a limit for the allowable accelerations placed on a participant.

Although this testing was not conducted on real participants, acceleration around the launch of each object was recorded. These accelerations were measured to serve as a guide to identify potential hazards or specific areas of concerns associated with the full commercial activity. The accelerations are shown in FIGS. 29 to 32. (Note: The data logger was not functioning correctly during Test 1 and no data was recorded.)

The acceleration data that was collected consisted of approximately 10 seconds of data starting just prior to the activity activation. The collected data demonstrated that the tested activity meets the requirements of the amusement standards and ASTM F2291-14 with respect to accelerations imparted to the participant. Furthermore the data indicates that the activity can be tuned to provide a number of different rider profiles while remaining compliant with the amusement standards, particularly the acceleration limits set within ASTM F2291-14.

The acceleration data collected also confirmed initial assumptions that the highest accelerations likely to be seen during the activity are at the initial launch and during the first redirection bounce.

The accelerations measured with the inline load cell and the initial launch accelerations from the accelerometer match very closely, as shown in Table 3 below. As this testing was intended to understand the behaviour of the concept activity at its limiting conditions, some of the accelerations are higher than allowed for in in ASTM F2291-14. These high accelerations were expected and desired during this test program.

TABLE 3

Acceleration comparison table.

| Test ID | Rider Details Mass [kg] | Bungy Line Extension [m] | Measured Force [N] | Calculated Acceleration [g's] | Measured Acceleration [g's] |
|---|---|---|---|---|---|
| Test 1 | 85 | 55 | 2325 | 2.79 | Not Recorded |
| Test 2 | 38 | 40 | 1410 | 3.78 | −3.8 |
| Test 3 | 38 | 40 | 3380 | 9.07 | −7.3 |
| Test 4 | 85 | 52 | 4420 | 5.30 | −4.3 |
| Test 5 | 135 | 70 | 5320 | 4.02 | −4.0 |

Outcomes

This testing accomplished the primary goal of validating the accuracy of the simulation tool in preparation for launch of a human amusement application. The testing showed that a safe activity can be designed as it is currently envisioned.

Example 5

Figure 33:
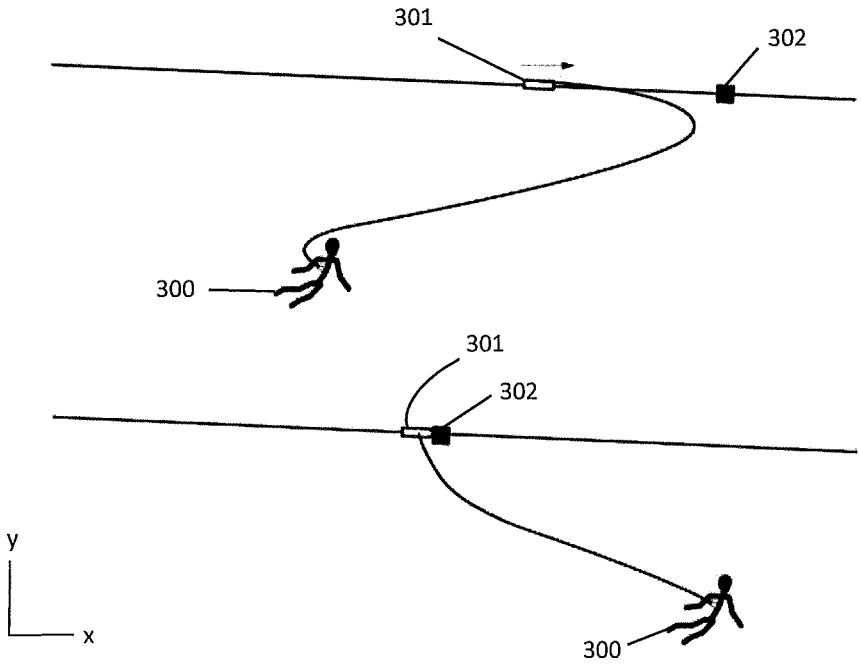
FIG. 33 illustrates an alternative embodiment where an object rider trolley hits a fixed rigid stop on the line.

FIG. 33 shows an alternative embodiment where an object 300 rider trolley 301 hits a fixed rigid stop 302 on the line 303, which causes a trajectory whereby the object 300 continues to fly past the stop 302 and swing in a large arc shape.

Example 6

Figure 34:
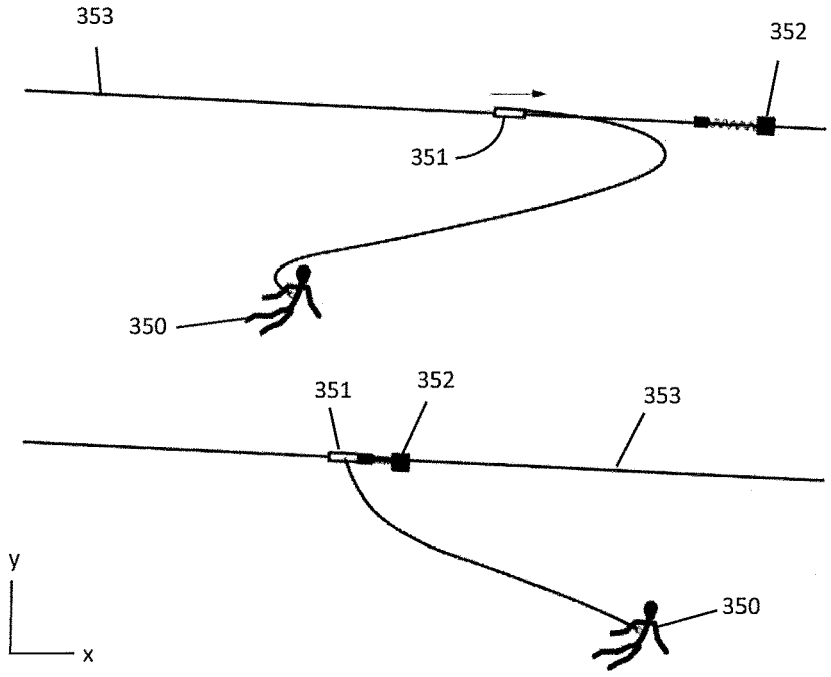
FIG. 34 illustrates an alternative embodiment where the object rider trolley hits a springy soft stop located on the line.

FIG. 34 shows an alternative embodiment, similar to the rigid stop of Example 5, however, in this Example, the object 350 rider trolley 351 hits a springy soft stop 352 located on the line 353. The springy soft stop causes the object 350 to continue flying past the stop 352 and swing in an arc shape that is controlled through damping with the soft stop 352. In this case, the arc is likely to be less exaggerated than in Example 5 since kinetic energy is partly absorbed by the springy soft stop 352.

Example 7

Figure 35:
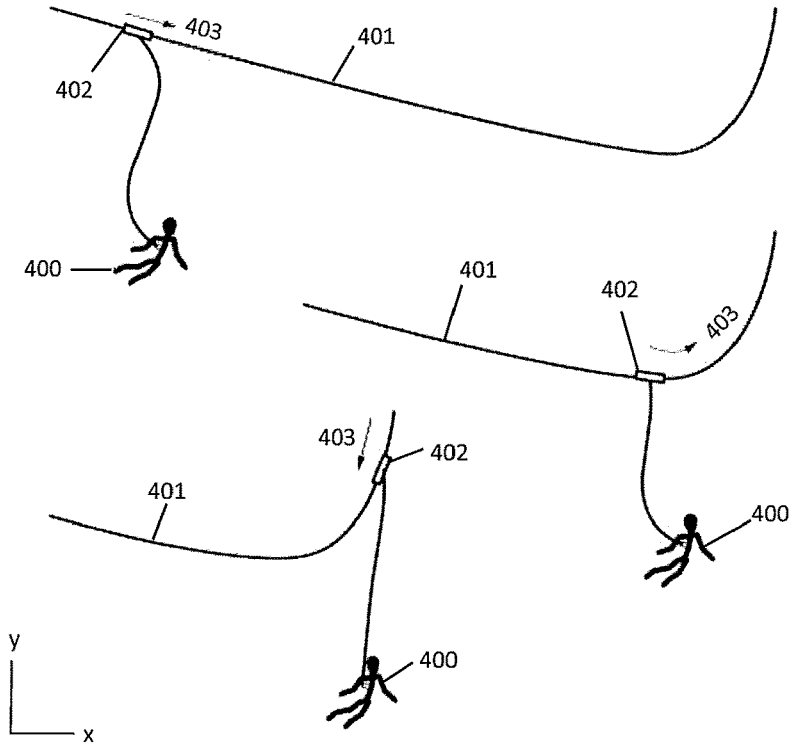
FIG. 35 illustrates an alternative embodiment that uses line shape and gravity to bring an object to a stop.

FIG. 35 illustrates an alternative embodiment that uses line 401 shape and gravity to bring an object 400 to a stop, in the example shown, by having the object/rider's 400 rider trolley 402 move along the line 401 in the direction generally marked by arrow 403. The degree of incline and change in direction influences the speed change.

Example 8

Figure 36:
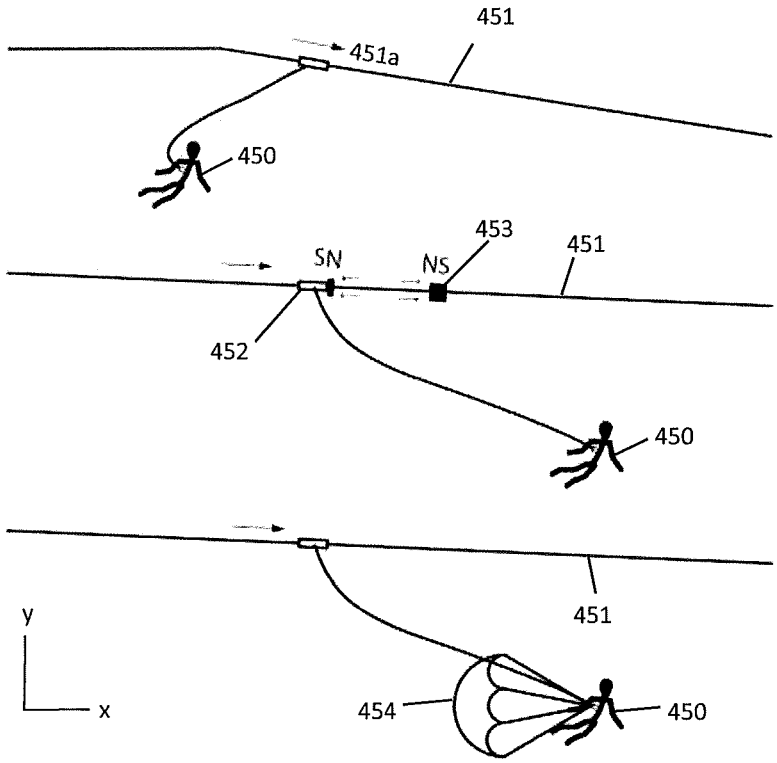
FIG. 36 illustrates different means to stop or slow rider movement.

FIG. 36, in the top image, shows an object/rider 450 being redirected due to the shape of the line 451, in this example downwards in arrow direction 451*a* and to accelerate rider 450 speed. The middle image shows an alternative soft stop option, in this case using magnetic repulsion instead of a spring as a means to slow/halt the rider 450. The rider's 450 rider trolley 452 has a magnetic field that opposes the magnetic field of a stop 453 located along the line 451. The bottom image illustrates a further alternative means to halt the rider 450, in this example using drag resistance (shown as a parachute 454) to provide an environmental stop. While a parachute 454 is shown causing wind resistance, the drag resistance force may instead be caused by the object/rider 450 being dragged through water or some other fluid. The parachute 454 is meant to be representative, as air drag will be affected by any cross sectional area, including the person's 450 own body.

Example 9

Figure 37:
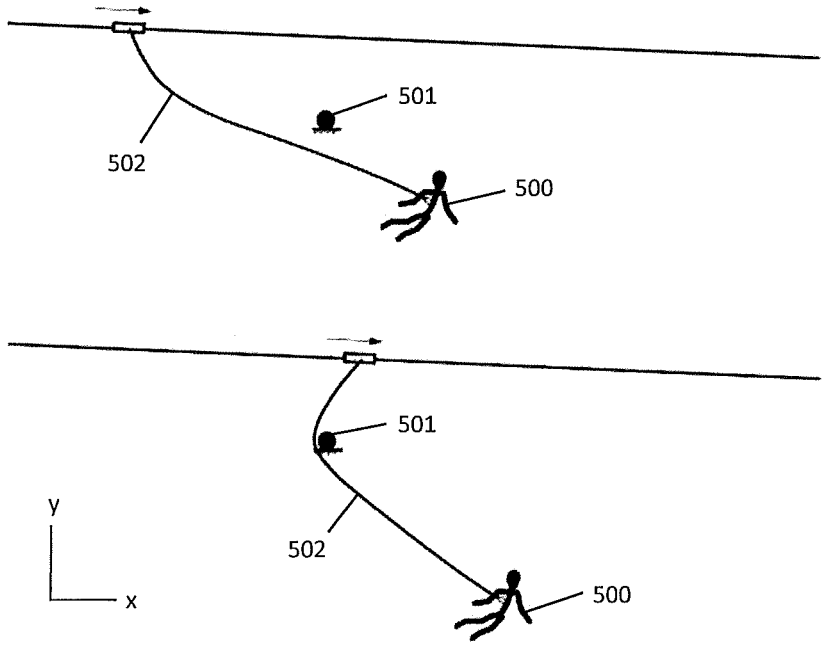
FIG. 37 illustrates a further alternative way of altering the object/rider flight trajectory.

FIG. 37 shows a further alternative way of altering the object/rider 500 flight trajectory. In the Example shown, an object 501 lies in the object/rider's 500 flight path. When the object/rider 500 passes by the object 501, their tether line e.g. the bungee cord 502 or a separate safety line (not shown), is captured on the object 501, which redirects the rider's 500 flight path.

Example 10

Figure 38:
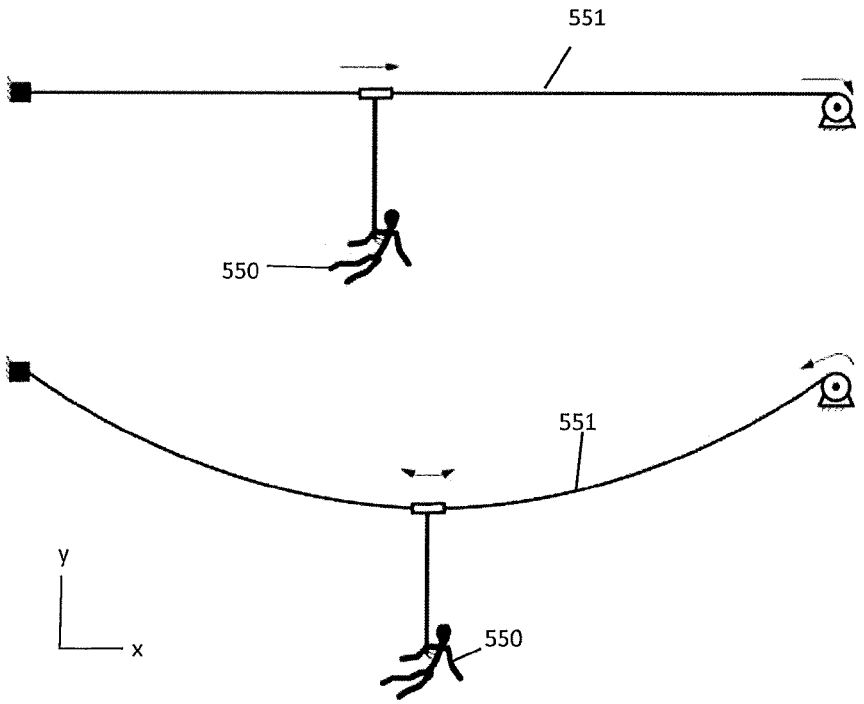
FIG. 38 illustrates an alternative embodiment in which the tension/length of the travel line is varied to control the position and motion of the rider on the line.

FIG. 38 shows an alternative embodiment in which the tension/length of the support line 551 is varied to control the position and motion of the rider 550 on the line 551. This is a way to increase the gravity braking in the system or to add/remove extra energy from the system to increase/decrease the rider's 550 speed.

Example 11

Figure 39:
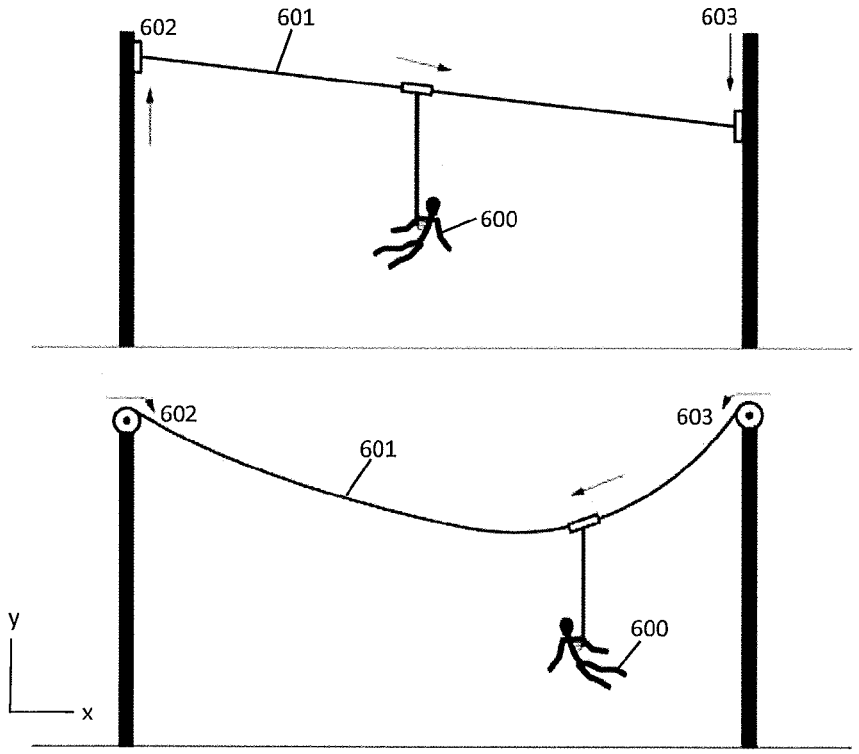
FIG. 39 illustrates an alternative means to vary the tension/length of the travel line, being accomplished in a different way by raising and lowering the line end points.

FIG. 39 shows a similar effect to that described in Example 10, being accomplished in a different way by raising and lowering the line 601 end points 602, 603. This produces a similar effect to varying the line 601 tension and thereby altering the rider 600 gravity.

Example 12

Figure 40:
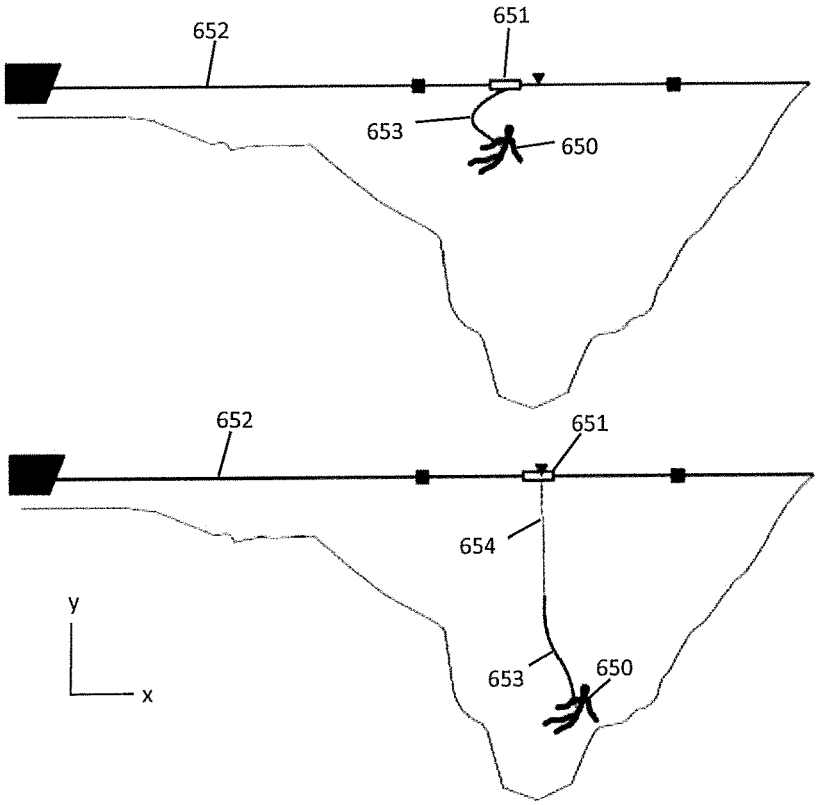
FIG. 40 illustrates a further embodiment where the rider's rider trolley travels along the overhead line and reaches a point in which the bungee line connected to the rider is triggered to extend.

FIG. 40 shows a further embodiment where the rider's 650 rider trolley 651 travels along the overhead line 652 and reaches a point in which the bungee line 653 connected to the rider 650 is triggered to extend (the extension shown as a dotted line 654 in the lower drawing). This provides a very unique travel path for the rider 650 and may effectively add on an additional traditional bungee jump (or semi-arc bungee jump if the rider 650 still carries forward momentum when the extension occurs).

Example 13

Figure 41:
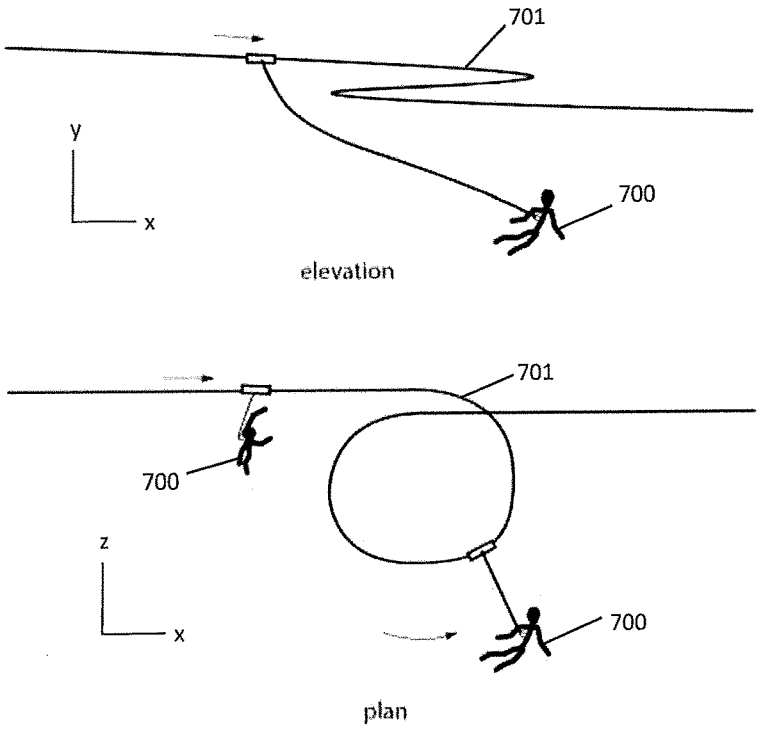
FIG. 41 illustrates an alternative embodiment where the rider has a flight path or trajectory that also encompasses movement in the z-axis.

FIG. 41 shows an alternative embodiment where the rider 700 has a flight path or trajectory 701 that also encompasses movement in the z-axis—that is 3-dimensional movement. The top drawing shows the movement from the side (side elevation view) while the lower drawing shows movement from a plan or top view illustrating the side to side z-axis movement.

Example 14

Figure 42:
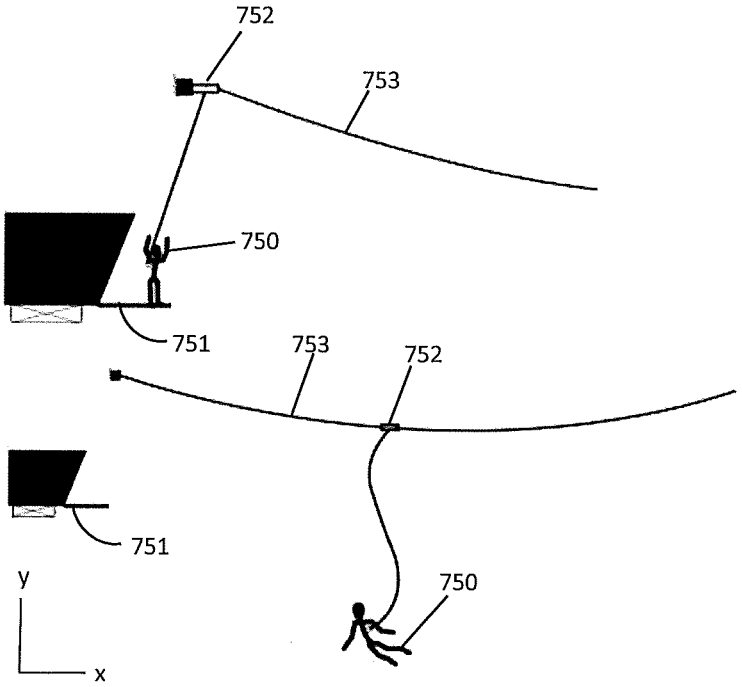
FIG. 42 illustrates an alternative embodiment having a vertical launch with predominantly y-axis initial movement.
Figure 43:
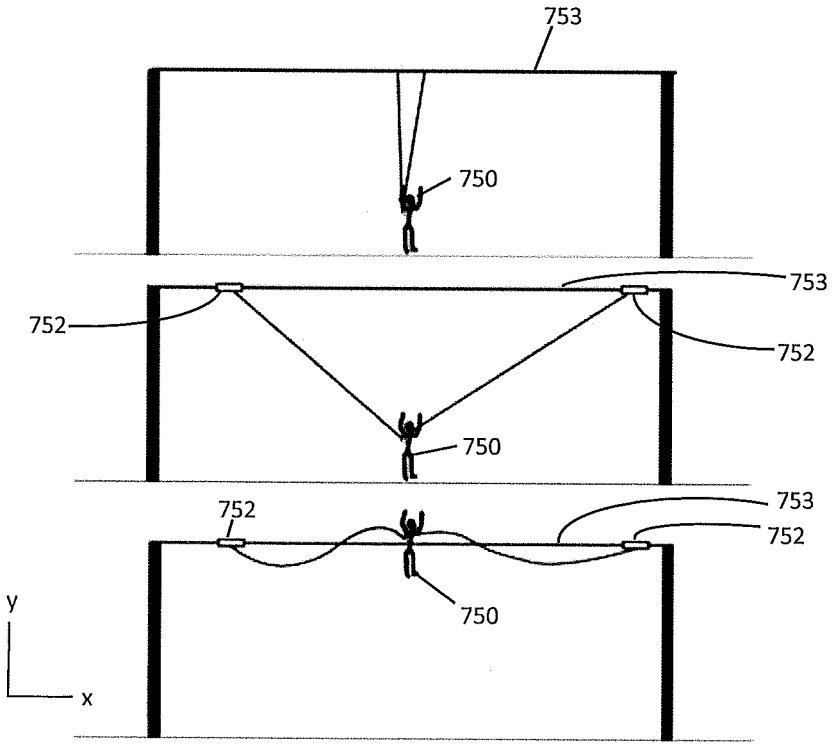
FIG. 43 illustrates an alternative embodiment having a vertical launch with predominantly y-axis initial movement.

FIGS. 42 and 43 illustrate two alternative versions of the apparatus, in this case having a vertical launch (predominantly y-axis movement), rather than the near horizontal (x-axis) launch described in earlier examples. FIG. 42 shows the rider 750 jumping from a platform 751, initially moving predominantly downwards along a y-axis with gravity and, as the rider trolley 752 takes up the rider 750 load, the rider trolley 752 is urged along the overhead line 753 in the x-axis direction by gravity, thereby giving the rider 750 forwards x-axis movement as well as y-axis movement. FIG. 43 illustrates an embodiment where the rider 750 is attached to the overhead line 753 about two rider trolleys 752 that move along the line 753 in an x-axis direction as the rider 750 moves up and down in a y-axis direction.

Example 15

Figure 44:
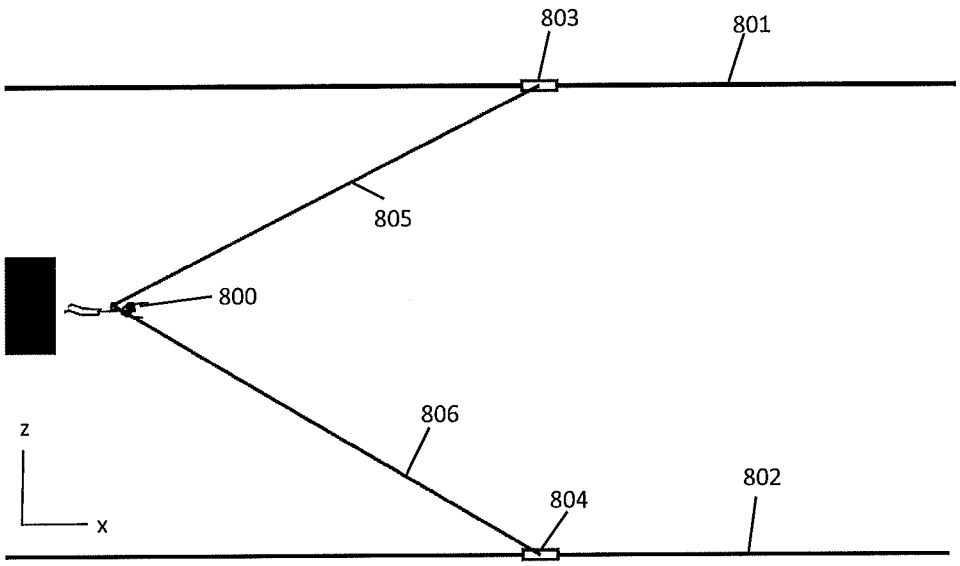
FIG. 44 illustrates an alternative embodiment using two lines for the rider trolleys to travel down.

FIG. 44 illustrates an alternative embodiment using two support lines 801, 802 for the rider trolleys 803, 804 to travel down, the rider 800 in this example riding between the two lines 801, 802 linked via two bungee (resilient) lines 805, 806. The lines 801, 802 can be parallel or not parallel along their length to vary the rider 800 trajectory and flight path.

Example 16

Figure 45:
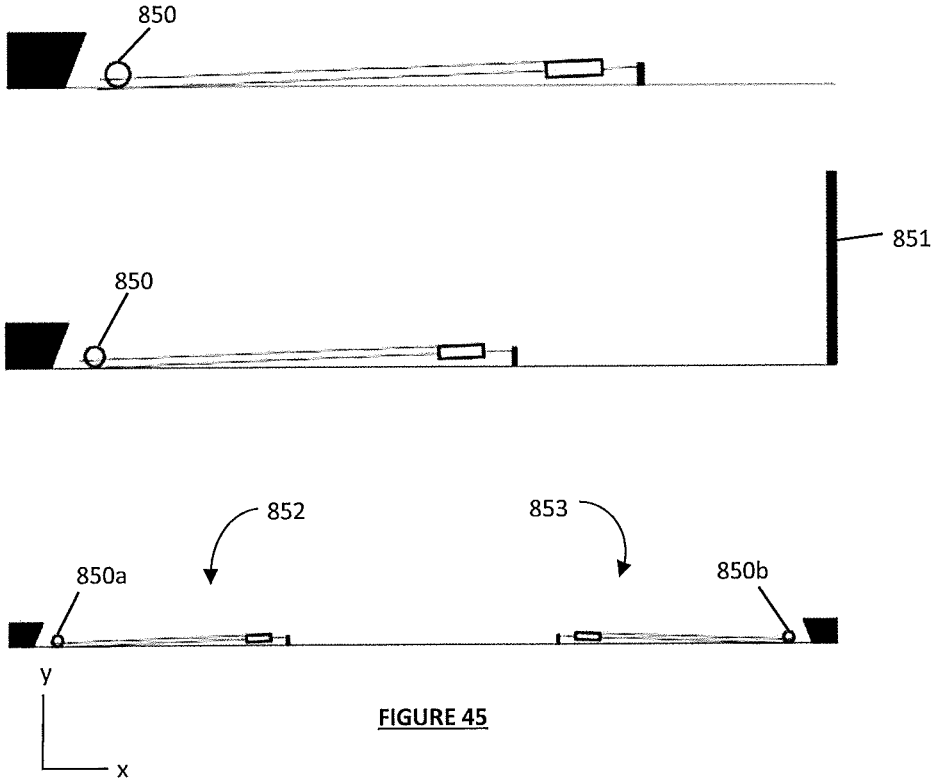
FIG. 45 illustrates an alternative embodiment used to move an object, rather than a person in a carnival or amusement game of skill.

FIG. 45 illustrates an alternative embodiment used to move an object 850 with the described system, rather than a person. For example, in a carnival or amusement game of skill, an object 850, connected to a system described above is launched towards a target 851 to score points or win a prize or prizes. Additionally, two systems 852, 853 could be established that allow competitors to fire objects 850*a*, 850*b* at one another and/or retrieving the object 850*a* or 850*b* that was fired—in a simulated war game or combat game of skill.

Example 17

Figure 46:
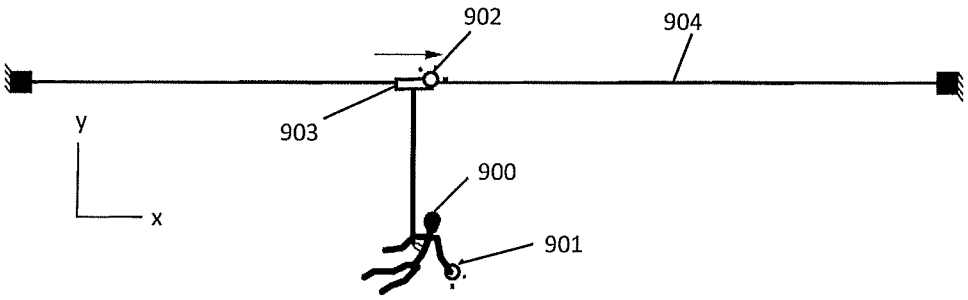
FIG. 46 illustrates a handheld brake embodiment that can be operated by the rider or operated remotely using a sensor system.

FIG. 46 shows a handheld brake embodiment 901 that can be operated by the rider 900 or operated remotely using a sensor system (not shown). Brake 901 actuation may then communicate with brakes 902 on the rider trolley 903 to aid in slowing down the rider relative to the support line 904.

Example 18

Figure 47:
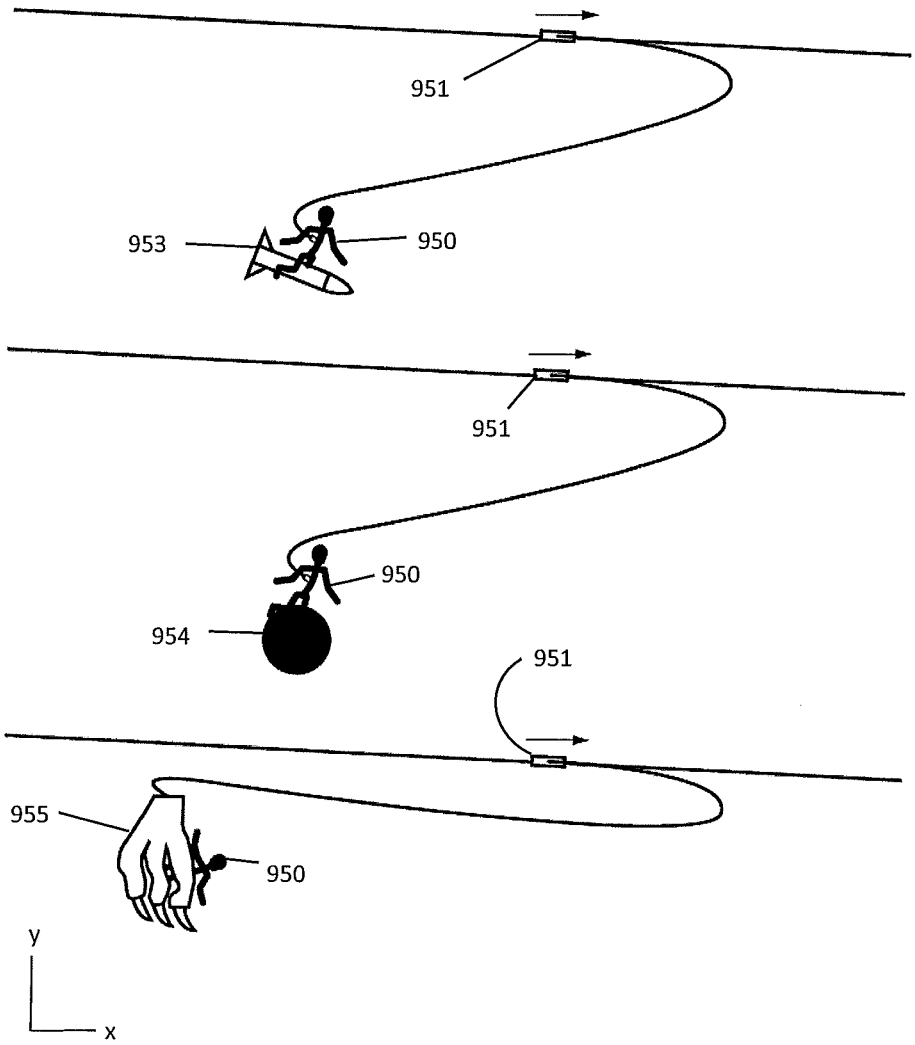
FIG. 47 illustrates various themes that could be incorporated into the rider's harness or on the rider trolley to enhance the experience or to vary by the travel path by varying the relative weights between the rider and the rider trolley.

FIG. 47 shows various themes that could be incorporated into the rider's 950 harness or on the rider trolley 951 to enhance the experience or to vary the travel path by varying the relative weights between the rider 950 and the rider trolley 951. For example, the top drawing illustrates a rocket 953 that the rider 950 rides during movement. The middle drawing illustrates a wrecking ball 954 that the rider 950 rides and perhaps strikes a wall or object with. The lower drawing illustrates a themed ride, in this case being giant eagle talons 955 that carry the rider 950 during movement.

Example 19

Figure 48:
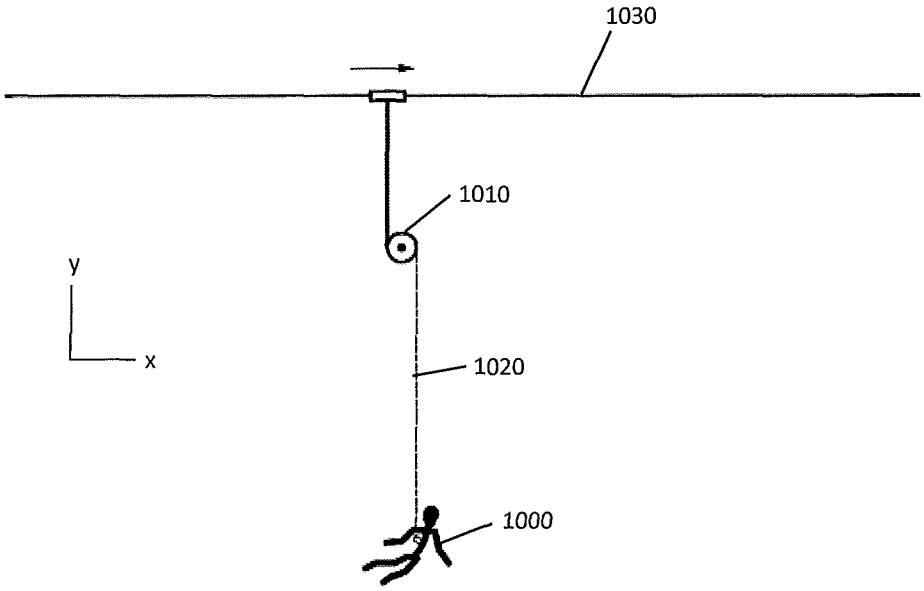
FIG. 48 illustrates a further alternative embodiment where an actuated spool can either extend line or retract line as the rider travels along the overhead line.

FIG. 48 illustrates a further alternative embodiment where an actuated spool 1010 can either extend line 1020 or retract line 1020 as the rider 1000 travels along the overhead line 1030 thereby changing the rider 1000 flight path and experience.

Example 20

Figure 49:
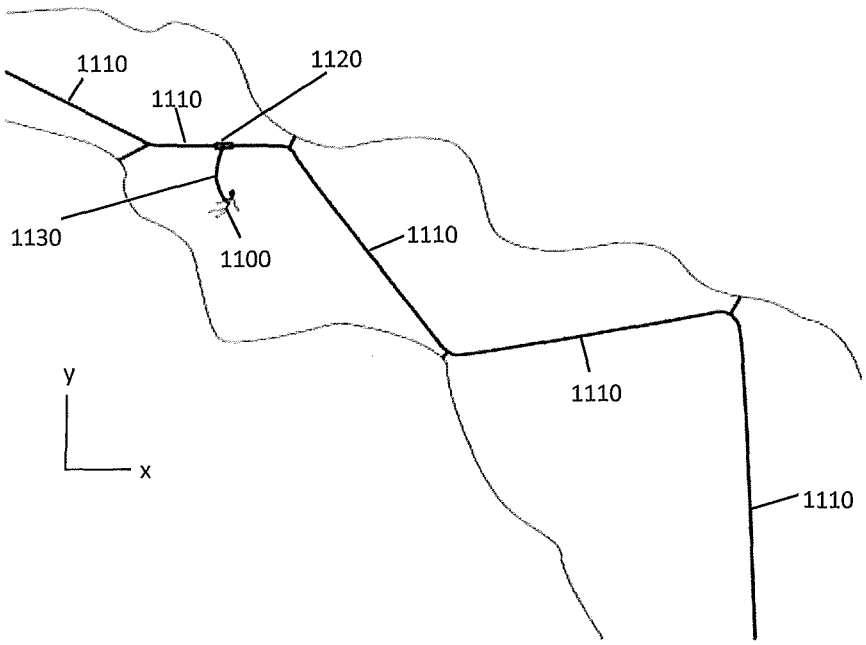
FIG. 49 illustrates an alternative means of varying the rider travel path using a vectored cable system.

FIG. 49 illustrates an alternative means of varying the rider 1100 travel path. In this example, a vectored support cable system 1110 is used, the rider 1100 rider trolley 1120 moving along the vectored support line 1110 and the changes in overhead line 1110 altering the bungee cord 1130 length (through y-axis velocity changes) and hence rider 1100 flight path.

Example 21

Figure 50:
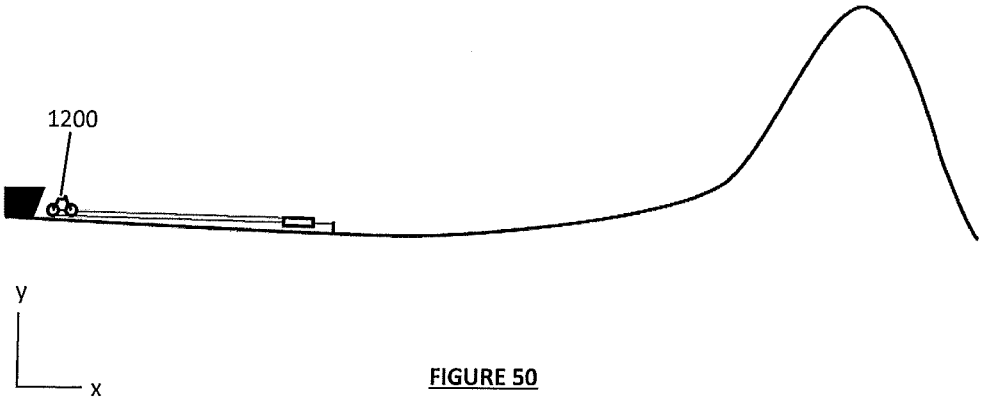
FIG. 50 illustrates how the apparatus may also be used as a launch system for riders 1200 participating in extreme/amusement sports.

FIG. 50 shows how the apparatus described herein may also be used as a launch system for riders 1200 participating in extreme/amusement sports, e.g. skiing, snowboarding, mountain biking, luge, go-karts etc.

As should be appreciated from the Examples and Figures, the apparatus described provides a means and method for moving an object such as a person through space in a controlled manner. The movement path created and the range of ways the movement path can be tuned present a novel way to move an object including giving the sensation of gliding along with other motion elements.

Aspects of the apparatus and method have been described by way of example only and it should be appreciated that modifications and additions may be made thereto without departing from the scope of the claims herein.

What is claimed is:

1. An apparatus to control movement of an object, the apparatus comprising:

(a) at least one object attached to at least one resilient member, wherein the at least one resilient member constrains movement of the at least one object in a substantially vertical y-axis direction; and (b) at least one support member moveably coupled to the at least one resilient member, wherein the at least one support member constrains resilient member movement along a set path relative to the at least one support member and, wherein the at least one support member has a positive or negative incline through at least part of the length of the at least one support member;

wherein, in use:

i. the at least one resilient member is energized prior to movement of the at least one object and, when movement of the at least one object is initiated, the at least one object moves substantially in the vertical y-axis direction, movement of the at least one object is constrained by the at least one resilient member, and the set path direction is constrained by the at least one support member; and ii. movement of the at least one object post initiation in the y-axis direction is independent of movement of the at least one resilient member along the set path.

2. The apparatus as claimed in claim 1 wherein the set path direction post movement initiation constrained by the at least one support member is along both a horizontal x axis direction and a vertical y-axis direction.

3. The apparatus as claimed in claim 1 wherein the at least one object post movement initiation moves via a path selected from: an S-shaped direction; a curved path; a spiral path; and combinations thereof.

4. The apparatus as claimed in claim 1 wherein the at least one resilient member is coupled to the at least one object at one first distal end.

5. The apparatus as claimed in claim 1 wherein, during movement of the at least one object, the at least one support member is located above at least part of the at least one resilient member.

6. The apparatus as claimed in claim 1 wherein at least part of the at least one support member is aligned in an inclined plane relative to a horizontal plane.

7. The apparatus as claimed in claim 1 wherein at least one coupling member couples the at least one resilient member to the at least one support member and the at least one coupling member moves along the at least one support member.

8. The apparatus as claimed in claim 7 wherein the at least one coupling member is at least one zipline trolley.

9. The apparatus as claimed in claim 1 wherein the at least one support member is or are manufactured from a substantially non-resilient material.

10. The apparatus as claimed in claim 1 wherein the at least one resilient member is in part energised prior to movement by increasing the stored energy in an energising force mechanism and, when movement is initiated, the energising force mechanism imparts non-gravitational energy to the at least one resilient member, the at least one object, or both, urging movement of the at least one resilient member, the at least one object, or both, in a substantially x-axis direction on initiation of movement.

11. The apparatus as claimed in claim 1 wherein movement initiation is controlled by: the at least one object, an external trigger or triggers, or combinations thereof.

12. The apparatus as claimed in claim 1 wherein the at least one object also moves in a lateral z-axis direction, the z-axis movement driven by a z-axis force generating means.

13. The apparatus as claimed in claim 1 wherein the at least one resilient member is a rubberised material.

14. The apparatus as claimed in claim 1 wherein the at least one support member has a shape selected from: catenary, U-shaped, curved, spiral, J-shaped; and combinations thereof.

15. The apparatus as claimed in claim 1 wherein movement of the at least one resilient member relative to the at least one support member is governed by at least one stop or re-direction point.

16. The apparatus as claimed in claim 1 wherein the at least one object is coupled to the at least one resilient member via: at least one harness; at least one vehicle; at least one carriage; at least one trolley; or combinations thereof.

17. The apparatus as claimed in claim 1 wherein movement is concluded by capture of the at least one object.

18. An apparatus to control movement of an object, the apparatus comprising:

(a) at least one object attached to at least one resilient member, wherein the at least one resilient member constrains movement of the at least one object in a substantially vertical y-axis direction; and (b) at least one support member moveably coupled to the at least one resilient member, wherein the at least one support member constrains resilient member movement along a set path relative to the at least one support member and, wherein the at least one support member has a positive or negative incline through at least part of the length of the at least one support member;

(c) at least one energising force mechanism that at least in part energises the at least one resilient member, the at least one object, or both, prior to movement with non-gravitational energy;

wherein, when movement of the at least one object is initiated, the at least one object moves substantially in a vertical y-axis direction constrained by the at least one resilient member, and independently, in a substantially horizontal x-axis direction constrained by the at least one support member; and wherein the at least one energising force mechanism urges movement of the at least one resilient member, the at least one object, or both, in a substantially x-axis direction on initiation of movement.

19. A method of moving an object through space in a controlled manner by the steps of:

(a) selecting an apparatus to control movement of an object, the apparatus comprising:

I. at least one object attached to at least one resilient member, wherein the at least one resilient member constrains movement of the at least one object in a substantially vertical y-axis direction; and II. at least one support member moveably coupled to the at least one resilient member, wherein the at least one support member constrains resilient member movement along a set path relative to the at least one support member and, wherein the at least one support member has a positive or negative incline through at least part of the length of the at least one support member;

wherein, in use:

i. the at least one resilient member is energized prior to movement of the at least one object and, when movement of the at least one object is initiated, the at least one object moves substantially in the vertical y-axis direction, movement of the at least one object is constrained by the at least one resilient member, and the set path direction is constrained by the at least one support member; and ii. movement of the at least one object post initiation in the y-axis direction is independent of movement of the at least one resilient member along the set path;

(a) attaching at least one object to the at least one resilient member;

(b) energising the at least one resilient member;

(c) initiating movement of the at least one object; and (d) allowing movement of the at least one object in both a vertical y-axis direction via the at least one resilient member, and a set path direction via the at least one support member.

* * * * *